US010245458B2

(12) United States Patent
Sato

(10) Patent No.: US 10,245,458 B2
(45) Date of Patent: Apr. 2, 2019

(54) MUSCLE TRAINING METHOD AND MUSCLE TRAINING SYSTEM

(71) Applicant: KAATSU JAPAN CO., LTD., Tokyo (JP)

(72) Inventor: Yoshiaki Sato, Tokyo (JP)

(73) Assignee: KAATSU JAPAN CO., LTD., Tokyo (JP)

( * ) Notice: Subject to any disclaimer, the term of this patent is extended or adjusted under 35 U.S.C. 154(b) by 554 days.

(21) Appl. No.: 14/910,087

(22) PCT Filed: Aug. 19, 2014

(86) PCT No.: PCT/JP2014/071678
§ 371 (c)(1),
(2) Date: Feb. 4, 2016

(87) PCT Pub. No.: WO2016/006123
PCT Pub. Date: Jan. 14, 2016

(65) Prior Publication Data

US 2016/0193491 A1 Jul. 7, 2016

(30) Foreign Application Priority Data

Jul. 9, 2014 (WO) ..... PCT/JP2014/068299

(51) Int. Cl.
*A63B 21/008* (2006.01)
*A63B 21/00* (2006.01)
(Continued)

(52) U.S. Cl.
CPC ..... *A63B 21/0085* (2013.01); *A63B 21/00* (2013.01); *A63B 21/06* (2013.01);
(Continued)

(58) Field of Classification Search
CPC ..... A63B 21/00; A63B 21/0085; A63B 21/06; A63B 21/4001; A63B 21/4025;
(Continued)

(56) References Cited

U.S. PATENT DOCUMENTS 6,149,618 A 11/2000 Sato
8,182,403 B2 5/2012 Sato
(Continued)

FOREIGN PATENT DOCUMENTS

CA 2874575 A1 1/2014
CN 101351245 A 1/2009
(Continued)

OTHER PUBLICATIONS

Weatherholt, et al., "Modified Kaatsu Training: Adaptations and Subject Perceptions", Medicine & Science in Sports & Exercise, 2013, pp. 952-961.
(Continued)

*Primary Examiner* — Megan Anderson
(74) *Attorney, Agent, or Firm* — Edell, Shapiro & Finnan, LLC

(57) ABSTRACT

A muscle training method includes the following steps that are repeated alternately to perform training of a muscle of a user: a pressuring and exercise step (S30, S50, S70, S90) of winding a belt around at least one of four limbs of the user and applying specific pressure thereto so as to restrict blood circulation of the muscle of the user without stopping the blood circulation, and asking the user to perform load-applied exercise to apply load of specific weight to the muscle of the user; and an exercise stopping step (S40, S60, S80, S100) of asking the user to stop the load-applied exercise while continuously applying the specific pressure to
(Continued)

the user. The specific weight is set at a value smaller than maximum weight necessary for the user to exert maximum muscle force.

6 Claims, 23 Drawing Sheets

(51) Int. Cl.
*A63B 21/06* (2006.01)
*A63B 23/12* (2006.01)
*A63B 71/06* (2006.01)

(52) U.S. Cl.
CPC ..... *A63B 21/4001* (2015.10); *A63B 21/4025* (2015.10); *A63B 23/1209* (2013.01); *A63B 71/0622* (2013.01); *A63B 2071/065* (2013.01); *A63B 2071/068* (2013.01); *A63B 2071/0625* (2013.01); *A63B 2071/0661* (2013.01); *A63B 2071/0675* (2013.01); *A63B 2209/10* (2013.01); *A63B 2220/56* (2013.01)

(58) Field of Classification Search
CPC ..... A63B 23/1209; A63B 71/0622; A63B 2071/0625; A63B 2071/065; A63B 2071/0661; A63B 2071/0675; A63B 2071/068; A63B 2209/10; A63B 2220/56
See application file for complete search history.

(56) References Cited

U.S. PATENT DOCUMENTS

D761,924 S * 7/2016 Sato ..... D21/662
9,775,619 B2 * 10/2017 Sato ..... A63B 21/0085
2006/0142128 A1 * 6/2006 Sato ..... A63B 21/0085 482/112
2006/0201522 A1 9/2006 Sato
2006/0229661 A1 * 10/2006 Sato ..... A63B 21/0085 606/201
2006/0270530 A1 * 11/2006 Sato ..... A63B 23/035 482/92
2006/0281611 A1 * 12/2006 Sato ..... A63B 23/035 482/148
2009/0221406 A1 9/2009 Sato
2011/0060231 A1 * 3/2011 Sato ..... A61B 17/1355 600/500
2011/0125036 A1 * 5/2011 Nakajima ..... A61B 5/0285 600/500
2011/0160022 A1 * 6/2011 Sato ..... A61H 9/0078 482/113
2014/0324097 A1 * 10/2014 Sato ..... A63B 71/0622 606/201
2016/0317864 A1 * 11/2016 Sato ..... A63B 23/00

FOREIGN PATENT DOCUMENTS

CN 202604947 U 12/2012
EP 1949939 A1 7/2008
EP 2196243 A1 6/2010
JP 2670421 B2 10/1997
JP 10085361 A 4/1998
JP 10085362 4/1998
JP 2004218135 A 8/2004
JP 2005006922 A 1/2005
JP 2006254960 A 9/2006
JP 2008161418 A 7/2008
JP 2012223507 A 11/2012
JP 2014028109 A 2/2014

OTHER PUBLICATIONS

Morita et al., "Effects of blood flow restriction on cerebral blood flow during a single arm-curl resistance exercise", International Journal of KAATSU Training Research, 2010, vol. 6, No. 1, 5 pages.
http://makotoseikotuin.com/service1.html, Oct. 8, 2013, Internet Archive WayBack Machine, 4 pages.

* cited by examiner

FIG. 8

| USERS | ARM (mmHg) | | LEG (mmHg) | |
|---|---|---|---|---|
| | ATTACHMENT PRESSURE | APPROPRIATE PRESSURE | ATTACHMENT PRESSURE | APPROPRIATE PRESSURE |
| ELDERLY (70~) | 15~20 | 40~60 | 20~30 | 60~90 |
| MIDDLE-AGED (50~69) | 20~30 | 60~90 | 30~40 | 90~130 |
| GENERAL (~49) | 30~40 | 90~130 | 40~50 | 130~160 |
| ATHLETE | 40~50 | 130~180 | 50~60 | 160~220 |

MUSCLE TRAINING METHOD AND MUSCLE TRAINING SYSTEM

TECHNICAL FIELD

The present invention relates to a muscle training method and a muscle training system.

BACKGROUND ART

Conventionally a KAATSU muscle training method has been proposed, which is capable of strengthening muscles effectively by applying load to muscles while restricting blood circulation thereto, and such a method has been put to practice use (see Patent Document 1, for example). In such a muscle training method, a muscle strengthening tool is used, which is configured to apply pressure to a muscle while tightening a predetermined part of four limbs (arms and legs) of a user with a tightening tool.

CITATION LIST

Patent Document

Patent Document 1: JP 2670421 B

DISCLOSURE OF THE INVENTION

Problem to be Solved by the Invention

Meanwhile recent studies show that, in order to strengthen muscles, growth hormones have to be produced more than usual from the pituitary gland, and to this end, the level of lactic acid in the blood has to be increased effectively. The inventor of the present application conducted a keen study to develop the conventional KAATSU muscle training method as described in Patent Document 1 as stated above, and as a result, found a new method to increase the level of lactic acid in the blood very effectively to strengthen muscles.

Meanwhile, there is a recent demand to perform a KAATSU muscle training method in a group of a plurality of users all together. Before a KAATSU muscle training method is performed, however, an trainer (instructor) who has much knowledge about the KAATSU muscle training method has to wind a belt around a body of users one by one and set appropriate pressure for each user to apply the pressure, and therefore it is difficult to perform a KAATSU muscle training method in a group of a plurality of users all together. As such, a system has been demanded to allow a KAATSU muscle training method to be performed in a group of a plurality of users all together.

The present invention aims to provide a method that is capable of strengthening muscles very effectively.

Means for Solving the Problem

To fulfill the above aim, a muscle training method according to the present invention includes the following steps that are repeated alternately to perform training of a muscle of a user: a pressuring and exercise step of winding a belt around at least one of four limbs of the user and applying specific pressure thereto so as to restrict blood circulation of the muscle of the user without stopping the blood circulation, and asking the user to perform load-applied exercise to apply load of specific weight to the muscle of the user; and an exercise stopping step of asking the user to stop the load-applied exercise while continuously applying the specific pressure to the user. The specific weight is set at a value smaller than maximum weight necessary for the user to exert maximum muscle force.

When such a method is used, specific pressure is applied to at least one of four limbs of a user in the pressuring and exercise step, which allows the user to perform load-applied exercise to receive load of specific weight to a muscle of the user while restricting the blood circulation of the muscle without stopping it. At this time, the specific weight is set at a value (a value of 20 to 30% of the maximum weight) smaller than maximum weight necessary for the user to exert maximum muscle force (the weight at which the user can perform load-applied exercise only once), which therefore can prevent the excess load from being applied to the user and so prevent injuries or the like. In the pressuring and exercise step, the blood circulation at the muscle of the user is restricted appropriately through the application of the specific pressure, and so the level of lactic acid in the blood can be increased compared with the state without the specific pressure being applied, and as a result, growth hormones can be produced more, so that higher effect of strengthening the muscle can be obtained even from relatively light load. Further in the exercise stopping step, the appropriate restriction of the blood circulation by the application of the specific pressure can be continued during the stopping of the load-applied exercise as well, and therefore the state of keeping the level of lactic acid in the blood actually can be created purposefully even though the user appears stopping the exercise, and as a result, high effect of strengthening the muscle can be obtained.

In the muscle training method according to the present invention, the specific weight is preferably set at 20 to 30% of the maximum weight.

In common muscle training, a user is generally asked to perform load-applied exercise a plurality of times to apply the load that is 70 to 80% of the maximum weight, and it has been found recently that such load applied cannot increase the level of lactic acid in the blood effectively considering (physical/mental) pain that the user suffers from. The inventor of the present application found that the combination of appropriate blood circulation restriction through the application of specific pressure and the load-applied exercise with relatively light load (load that is 20 to 30% of the maximum weight) enables an effective increase in the level of lactic acid in the blood while reducing pain of the user.

In the muscle training method according to the present invention, when the pressuring and exercise step is performed a plurality of times, the number of the load-applied exercise performed in the first pressuring and exercise step is preferably set more than the number of the load-applied exercise performed in the second pressuring and exercise step or later.

In this way, the number of the load-applied exercise performed in the first pressuring and exercise step is set more than the number of the load-applied exercise performed in the second pressuring and exercise step or later, whereby the level of lactic acid in the blood can be increased very effectively from the very beginning of performing of the present method, and so the effect of strengthening muscles can be increased more.

In the muscle training method according to the present invention, the number of the load-applied exercise performed in the first pressuring and exercise step may be set at 20 to 60 (preferably 25 to 30), and the number of the load-applied exercise performed in the second pressuring and exercise step may be set at 12 to 15 (½ or less of the number of the load-applied exercise performed in the first pressuring and exercise step). When the pressuring and exercise step is performed three times or more, the number of the load-applied exercise performed in the third pressuring and exercise step may be set at 7 to 8 (½ or less of the number of the load-applied exercise performed in the second pressuring and exercise step). When the pressuring and exercise step is performed four times, the number of the load-applied exercise performed in the fourth pressuring and exercise step may be set at 2 to 3 (½ or less of the number of the load-applied exercise performed in the third pressuring and exercise step).

In the muscle training method according to the present invention, when the belt is wound around an arm of the user and the specific pressure is applied thereto in the pressuring and exercise step, stopping duration of the load-applied exercise in the exercise stopping step may be set at 10 to 20 seconds (e.g., 15 seconds).

In the case of applying the specific pressure to an arm of the user, the stopping duration of the load-applied exercise is set at the specific duration (10 to 20 seconds), whereby higher effect of strengthening the muscle can be obtained. If the stopping duration of the load-applied exercise is less than 10 seconds when the specific pressure is applied to an arm, the user does not feel like pausing and so is not inspired to perform the following load-applied exercise. If the stopping duration of the load-applied exercise exceeds 20 seconds, this means that the blood-circulation restriction state lasts relatively long, and so the subsequent load-applied exercise becomes physically difficult, and so both of these durations are not preferable.

In the muscle training method according to the present invention, when the belt is wound around a leg of the user and the specific pressure is applied thereto in the pressuring and exercise step, stopping duration of the load-applied exercise in the exercise stopping step may be set at 25 to 35 seconds (e.g., 30 seconds).

In the case of applying the specific pressure to a leg of the user, the stopping duration of the load-applied exercise is set at the specific duration (25 to 35 seconds), whereby higher effect of strengthening the muscle can be obtained. If the stopping duration of the load-applied exercise is less than 25 seconds when the specific pressure is applied to a leg, the user does not feel like pausing and so is not inspired to perform the following load-applied exercise. If the stopping duration of the load-applied exercise exceeds 35 seconds, this means that the blood-circulation restriction state lasts relatively long, and so the subsequent load-applied exercise becomes physically difficult, and so both of these durations are not preferable.

The muscle training method according to the present invention further includes a pressure setting step to set the specific pressure preferably. The pressure setting step may include attachment step, in which the belt is wound around at least one of four limbs of the user for attachment with specific attachment pressure, pressurization step, in which pressure higher than the specific attachment pressure is applied to the user, and depressurization step, in which the pressure applied in the pressurization step is removed to return to the specific attachment pressure. The pressurization step and the depressurization step may be performed alternately a plurality of times while setting a value of pressure in a pressurization step larger than a value of pressure in a preceding pressurization step, and the pressure applied when color of a palm of the user turns red or reddish brown in the pressurization step may be set as the specific pressure.

When such a method is used, appropriate specific pressure can be set safely for the user while considering individual differences and the physical condition or the like of the user. Further when the appropriate specific pressure is found, pressurization and depressurization are repeated while increasing the setting pressure from lower pressure gradually, whereby blood vessels also can be strengthened in the process. The inventor of the present application found through longtime study that specific load-applied exercise with the pressure when the palm of the user turns red or reddish brown can lead to the best effect of strengthening the muscle. In the present method, the pressure when the palm of the user turns red or reddish brown is set as the specific pressure, whereby high effect of strengthening muscles can be obtained.

A muscle training system according to the present invention includes: a belt including a gas bag and that is configured to, while being wound around a specific part of four limbs of a user, apply pressure based on an amount of gas in the gas bag to the specific part; and a controller that is configured to control an amount of gas supplied to and discharged from the gas bag of the belt, thereby controlling pressure applied to the specific part from the belt. The controller includes a supplying/discharging control unit to control an amount of gas supplied to and discharged from the gas bag of the belt so that specific pressure in the muscle training method according to the present invention is applied to the specific part from the belt, and the supplying/discharging control unit is stored in a case having a size enabling attachment to the belt.

When such a configuration is used, the controller having a size enabling attachment to the belt and of a relatively small size is attached to the belt, and the amount of gas supplied to and discharged from the gas bag provided in the belt is controlled by the supplying/discharging control unit of the controller, whereby specific pressure can be applied to a specific part of the user from the belt. Then, a plurality of sets of the belt and the controller may be used, whereby specific pressure can be applied to a plurality of users at one time, and so muscle training in a group (group lesson) can be implemented.

In the muscle training system according to the present invention, the controller may include an information recorder to record the specific pressure, and the supplying/discharging control unit may control an amount of gas supplied to and discharged from the gas bag of the belt so that the specific pressure read from the information recorder is applied to the specific part from the belt.

When such a configuration is used, specific pressure for each user can be recorded at the information recorder beforehand, and the specific pressure read from the information recorder can be used to control the amount of gas supplied and discharged. Therefore, this can save the need of inputting the specific pressure on site.

In the muscle training system according to the present invention, the controller may include an information receiving unit to receive the specific pressure set by an external device, and the information recorder may record the specific pressure received by the information receiving unit.

When such a configuration is used, specific pressure set by an external device can be received by the information receiving unit, and the specific pressure received can be recorded at the information recorder. Therefore, this can facilitate updating of the specific pressure.

In the muscle training system according to the present invention, the controller may include an input unit to input the specific pressure, and the information recorder may record the specific pressure input by the input unit.

When such a configuration is used, specific pressure can be input by the input unit, and the specific pressure input can be recorded at the information recorder. Therefore, this can facilitate updating of the specific pressure.

In the muscle training system according to the present invention, the information recorder may be detachable from the case.

When such a configuration is used, the information recorder can be detached from the case, specific pressure can be written at the information recorder by an external device, and then the information recorder with the specific pressure written thereon can be attached to the case. Therefore, this can facilitate updating of the specific pressure.

In the muscle training system according to the present invention, the controller may include an input unit to input the specific pressure, and the supplying/discharging control unit may control an amount of gas supplied to and discharged from the gas bag of the belt so that the specific pressure input by the input unit is applied to the specific part from the belt.

When such a configuration is used, specific pressure can be input by the input unit, and the specific pressure input can be used to control the amount of gas supplied and discharged. Therefore, there is no need to provide the information recorder at the controller, and so the configuration of the controller can be simplified, and the cost of the controller can be reduced. Even when specific pressure is recorded at the information recorder beforehand, the specific pressure can be changed flexibly depending on the physical condition or the like of the user.

In the muscle training system according to the present invention, the controller may control pressure applied to the specific part from the belt so that pressurization operation to apply specific pressure to the specific part and depressurization operation to remove pressure applied to the specific part in the pressurization operation are repeated alternately, and when the pressurization operation is implemented a plurality of times, pressure in a pressurization operation may be set larger than pressure in a preceding pressurization operation.

When such a configuration is used, a pressurization/depressurization program that is warmup exercise of the muscle training method according to the present invention can be performed automatically using the controller, and therefore the workload on the instructor can be reduced greatly.

Effect of the Invention

The present invention can provide a method that is capable of strengthening muscles very effectively.

BRIEF DESCRIPTION OF THE DRAWINGS

FIG. 8 is a table showing attachment pressure and appropriate pressure for each subject set in the muscle training method according to the first embodiment of the present invention.

MODE FOR CARRYING OUT THE INVENTION

The following describes embodiments of the present invention, with reference to the drawings. In the following, a muscle training method according to the embodiments is referred to as "KAATSU training".

First Embodiment

Figure 1:
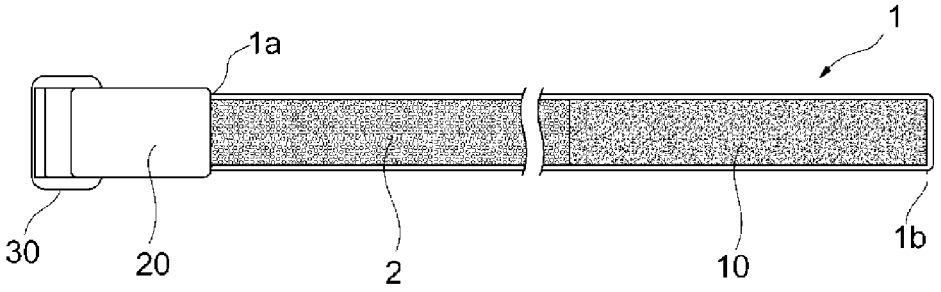
FIG. 1 is a plan view (showing an outer face) of a belt used in a muscle training method according to a first embodiment of the present invention.
Figure 2:
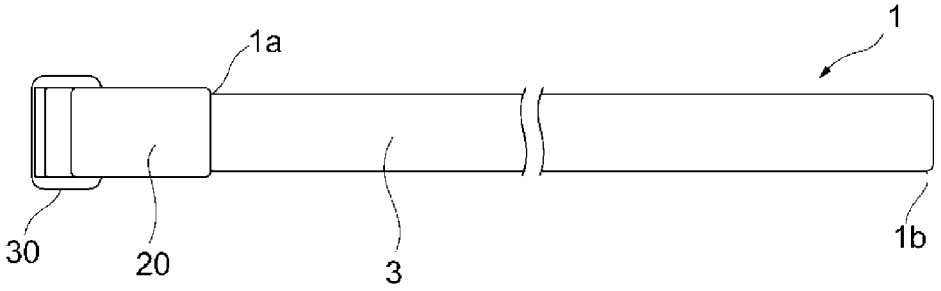
FIG. 2 is a bottom view (showing an inner face) of the belt shown in FIG. 1.
Figure 3:
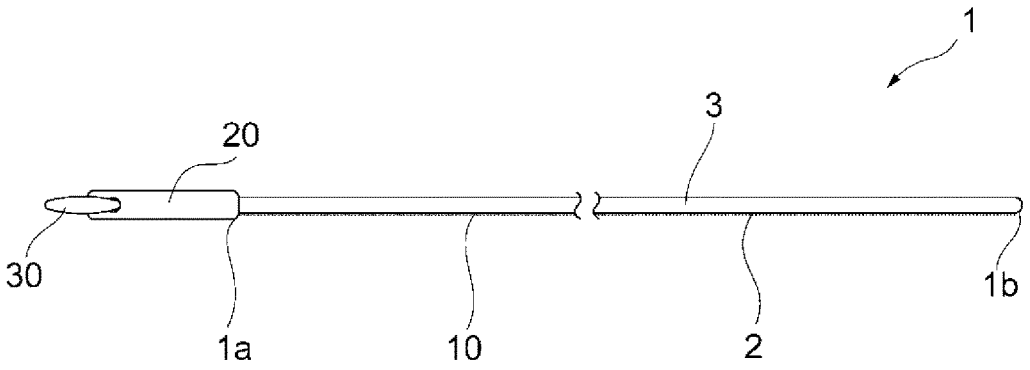
FIG. 3 is a side view of the belt shown in FIG. 1.

Referring first to FIGS. 1 to 8, the following describes a muscle training method (KAATSU training) according to a first embodiment of the present invention. Firstly referring to FIGS. 1 to 5, a belt 1 and a pressure applying/removing controller 100 used in KAATSU training according to the present embodiment are described. FIG. 1 shows an outer face (exposed to the outside) of the belt 1, FIG. 2 shows an inner face (facing the muscle) of the belt 1, and FIG. 3 is a side view of the belt 1.

The belt 1 is a belt-like member that is wound around at least one of four limbs of a user P (FIG. 4) to apply pressure to a muscle of the user, and is made of a material having elasticity, for example (preferably neoprene rubber). The belt 1 may be wound around a part of the body, including a part close to the base of an arm (FIG. 4) or a part close to the base of a leg, which is a part appropriate to restrict the blood circulation without stopping it when the part is tightened externally.

As shown in FIG. 1, the belt 1 is provided with a hook-and-loop fastener 10 on the outer face (exposed to the outside) 2. The hook-and-loop fastener 10 is to keep the loop shape of the belt 1 in the state where pressure is applied to a muscle. The hook-and-loop fastener 10 may be provided at an appropriate position depending on the length or the like of the belt 1. The hook-and-loop fastener 10 may be provided on the inner face 3 of the belt 1.

The belt 1 has one end 1*a*, to which a buckle 30 is attached via a coupling member 20. The buckle 30 is to allow the belt 1 at the other end 1*b* to pass therethrough during winding-around of the belt and then to allow the belt 1 to be folded back. The coupling member 20 is a member to couple the one end 1*a* of the belt 1 and the buckle 30, which is made of a material having flexibility, such as artificial leather.

The belt 1 is internally provided with a gas bag not illustrated. The gas bag is made of a material having airtightness. For instance, the gas bag may be made of rubber having elasticity similar to that of a rubber bag used for a manchette, for example. The material of the gas bag is not limited to this, as long as it may be an appropriately selected material to keep airtightness. The length of the gas bag is set substantially the same as the length of the perimeter of a part to which the belt 1 is wound around, which does not always have to be set like this. The width of the gas bag may be determined appropriately depending on the part to which the belt 1 is wound around.

The gas bag is provided with a connection port not illustrated that is in communication with the interior of the gas bag, and so is connectable to a pressure applying/removing controller 100 (FIG. 5) via a connecting tube 200 (FIG. 5) made up of an appropriate tube, such as a rubber tube. As described later, gas (air in the present embodiment) is fed into the gas bag through this connection port, or the gas in the gas bag goes out to the outside through this.

In the present embodiment, a plurality of belts 1 (specifically four) is used. Four belts 1 are used because pressure can be applied to both arms and both legs of a person who performs muscle training. The number of the belts 1 is not always four, which may be any number that is one or more. The belts 1 in the same number do not have to be used for the belts 1 for arms and for the belts 1 for legs. When KAATSU training has to be performed for a plurality of persons at one time, the number of the belts 1 may exceed four.

The length of the belt 1 in the present embodiment may be determined depending on the length of the perimeter of a body part of the person who performs KAATSU training, to which the belt 1 is wound around. The length of the belt 1 may be longer than the length of the perimeter of a part to which the belt 1 is wound around. The length of the belt 1 for arms in the present embodiment is determined while considering that the length of the perimeter of a part of the arm of the person who performs KAATSU training to which the belt is wound around is 26 cm, and specifically the length is set at 40 cm. The length of the belt 1 for legs is determined while considering that the length of the perimeter of a part of the leg of the person who performs KAATSU training to which the belt is wound around is 45 cm, and specifically the length is set at 70 cm.

The width of the belt 1 in the present embodiment may be determined appropriately depending on the part to which the belt 1 is wound around. For instance, when the belt 1 is used for arms, it may have the width within the range of 2.5 to 3 cm, and when the belt 1 is used for legs, it may have the width within the range of 5 to 6 cm.

Figure 4:
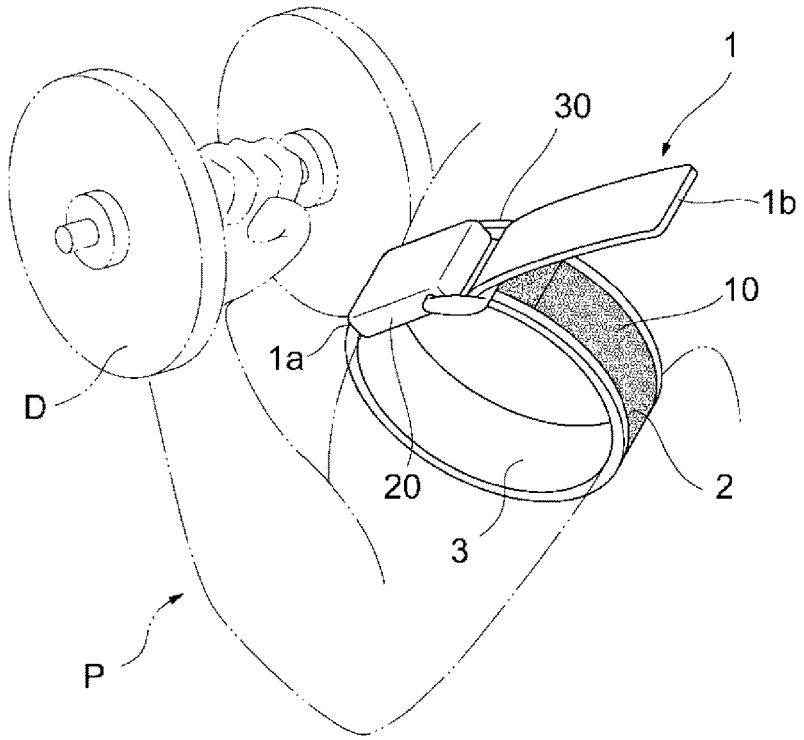
FIG. 4 shows the belt in FIG. 1 in use.

FIG. 4 shows a state where the belt 1 for arm is wound around the base of the arm of the user P for attachment. When the belt 1 for arm is attached to the base of the arm of the user P, firstly, the belt 1 is wound around the base of the arm to form a loop shape, and as shown in FIG. 4, the other end 1*b* of the belt 1 is passed through the buckle 30 attached to the one end 1*a* of the belt 1 and the belt 1 is folded back, and then the belt 1 is tightened while holding the other end 1*b* of the belt 1 passed through the buckle 30. Then, while applying predetermined pressure by tightening the belt 1, the loop shape of the belt 1 is kept using the hook-and-loop fastener 10. Thereby, the belt 1 can be attached to the base of the arm of the user P while applying the predetermined pressure to a desired muscle of the user.

As shown in FIG. 4, when air is sent into the gas bag while keeping the attachment of the belt 1 at the base of the arm of the user P, the belt 1 tightens the muscle and applies pressure thereto. Conversely, when air is pulled out of the gas bag in this state, pressure applied to the muscle from the belt 1 is reduced.

The pressure applying/removing controller 100 may be any device as long as it is configured to feed gas into the gas bag and remove gas from the gas bag. The pressure applying/removing controller 100 controls feeding of gas into the gas bag or removing of gas therefrom. The pressure applying/removing controller 100 may have any configuration as long as it can feed gas into the gas bag and can remove gas from the gas bag, or can perform automatic control as stated above.

Figure 5:
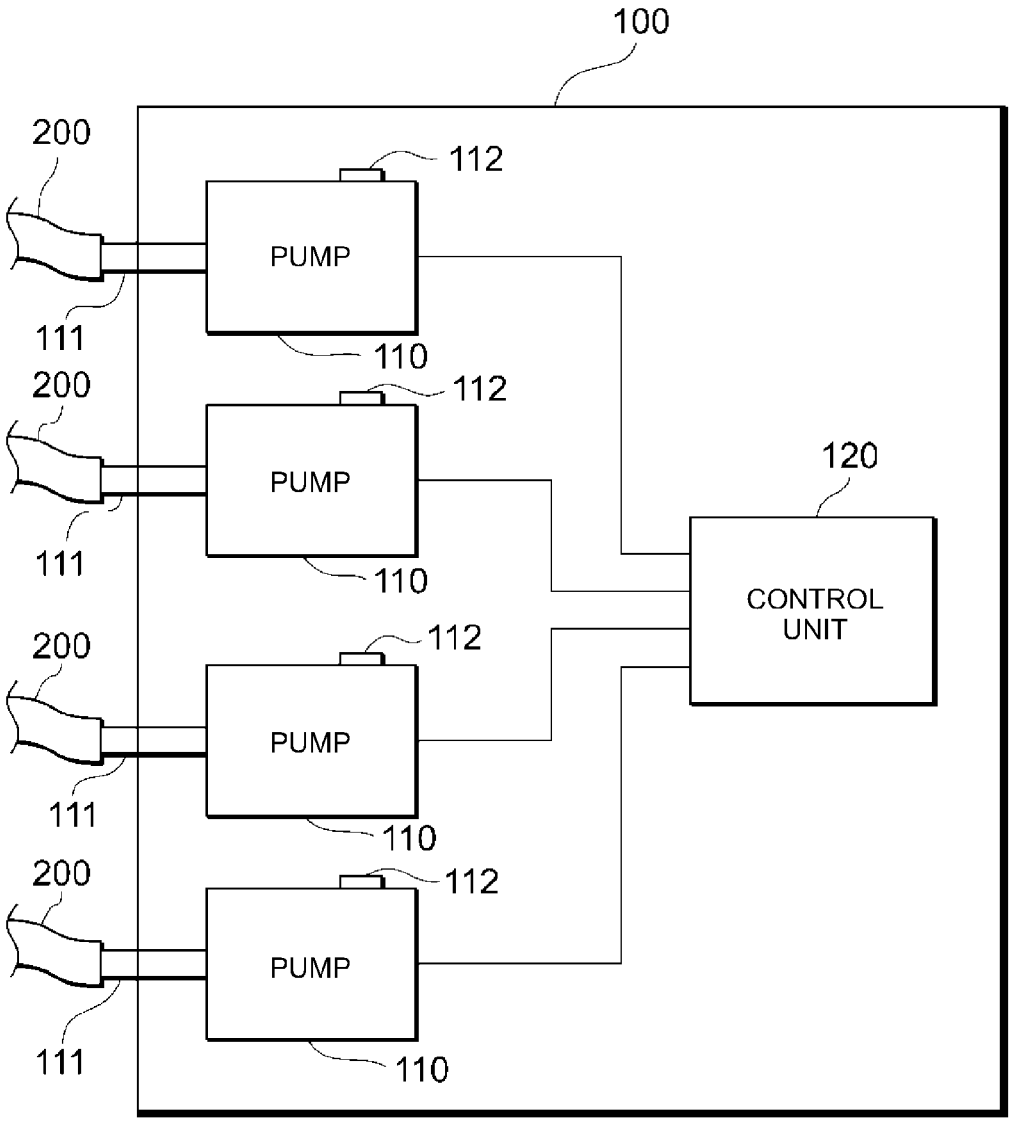
FIG. 5 is a block diagram showing the configuration of a pressure applying/removing controller used in the muscle training method according to the first embodiment of the present invention.

FIG. 5 schematically shows the configuration of the pressure applying/removing controller 100 as one example. As shown in FIG. 5, the pressure applying/removing controller 100 includes four pumps 110 and a control unit 120. In the present embodiment, the pressure applying/removing controller 100 includes a case, in which the pumps 110 and the control unit 120 are stored. On the outside of the case, an input device is provided so as to be connected to the control unit 120, which is not illustrated in the drawing.

The four pumps 110 are associated with the four belts 1, respectively. The pumps 110 have a function to draw gas around them (air in the present embodiment) and send the gas to the outside via a pump connection port 111. Each pump 110 is provided with a valve 112 as well, and releasing of the valve 112 allows gas inside of the pump 110 to be discharged to the outside. Each of the four pumps 110 is provided with the pump connection port 111, and is connected to the gas bag provided in the belt 1 via the connecting tube 200 connected thereto and the pump connection port 111. When the pump 110 sends gas, the gas can be fed into the gas bag, and when the pump 110 releases the valve 112, the gas can be removed from the gas bag. Note here that the valve 112 does not always have to be provided at the pump 110, which may be provided at any part on the route from the pump 110 to the gas bag.

Each pump 110 is provided with a not-illustrated pressure indicator built therein, with which the pressure in the pumps 110 can be measured. The pressure in the pump 110 is naturally equal to the pressure in the gas bag. This pressure in the gas bag corresponds to the pressure that the belt 1 applies to a muscle.

The control unit 120 controls the pumps 110. The control unit 120 controls the pumps by driving the pumps 110 while closing the valves 112 to send air to the gas bags of the belts 1, or by releasing the valves 112 of the pumps 110 to remove air in the gas bags, so that the pressure in the pumps 110 measured by their pressure indicators becomes a predetermined setting value. That is, the control unit 120 is configured to control the pumps 110, including the opening/closing of the valves 112. The trainer (instructor) of KAATSU training performs input operation with the input device to set pressure, and activates the control unit 120, whereby the control unit 120 drives and controls the pumps 110 so that the pressure in the gas bags of the belts 1 can agree with the setting value.

Next, referring to flowcharts of FIG. 6 and FIG. 7 and the table in FIG. 8, the muscle training method (KAATSU training) according to the present embodiment is described below.

Figure 6:
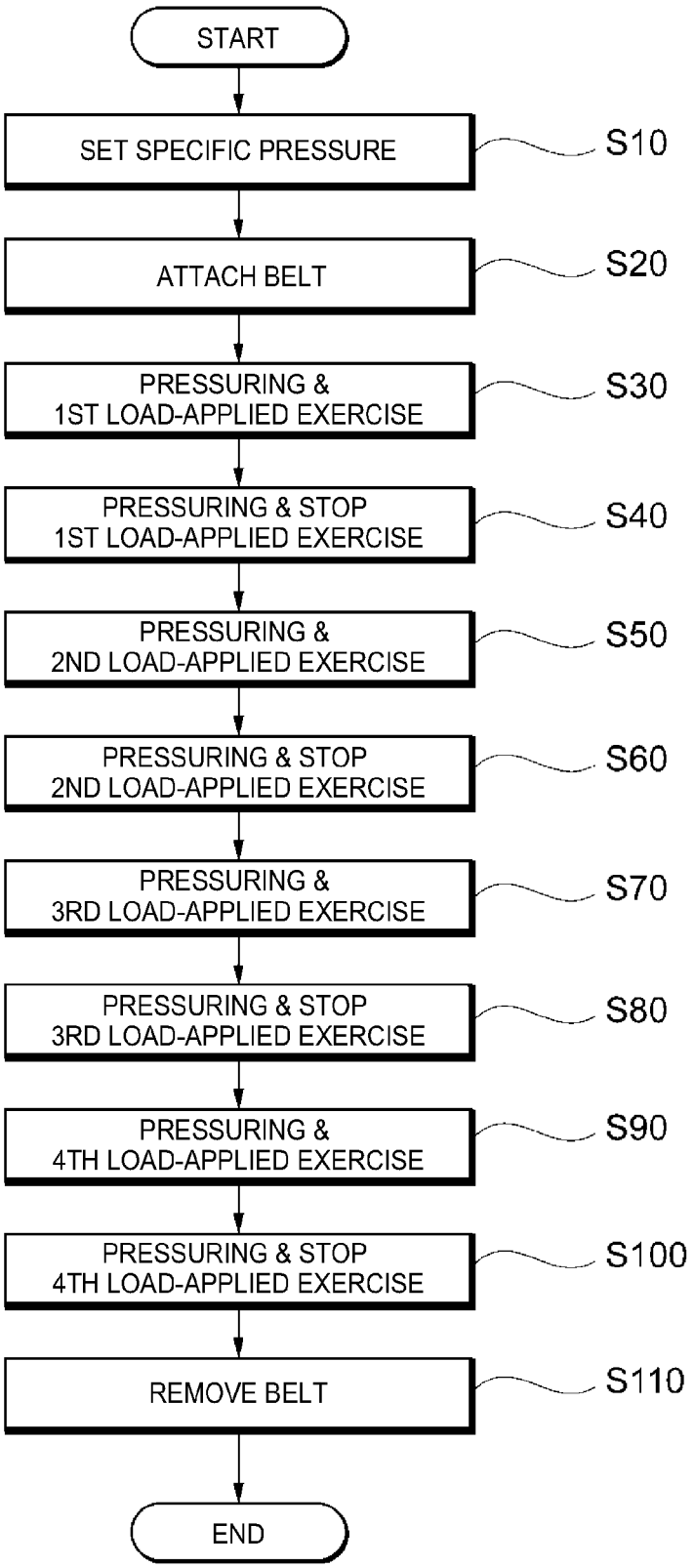
FIG. 6 is a flowchart to describe the muscle training method according to the first embodiment of the present invention.

As shown in FIG. 6, the muscle training method (KAATSU training) according to the present embodiment is a method, in which a pressuring and exercise step (S30 or the like) and an exercise stopping step (S40 or the like) are repeated alternately to strengthen a muscle of a user P, in the pressuring and exercise step, the belt 1 is wound around at least one of four limbs of the user P (FIG. 4) to apply specific pressure thereto so as to restrict the blood circulation at a muscle of the user P without stopping it, and then the user P is asked to perform load-applied exercise a plurality of times to apply the load of specific weight to the muscle of the user P, and in the exercise stopping step, load-applied exercise is stopped while continuing the application of the specific pressure. The following describes each step specifically.

Firstly, before performing the pressuring and exercise step (S30 or the like), the specific pressure to be applied to at least one of four limbs of the user P is set (pressure setting step: S10). Referring to the flowchart of FIG. 7 and the table of FIG. 8, this pressure setting step S10 is described in details.

Figure 7:
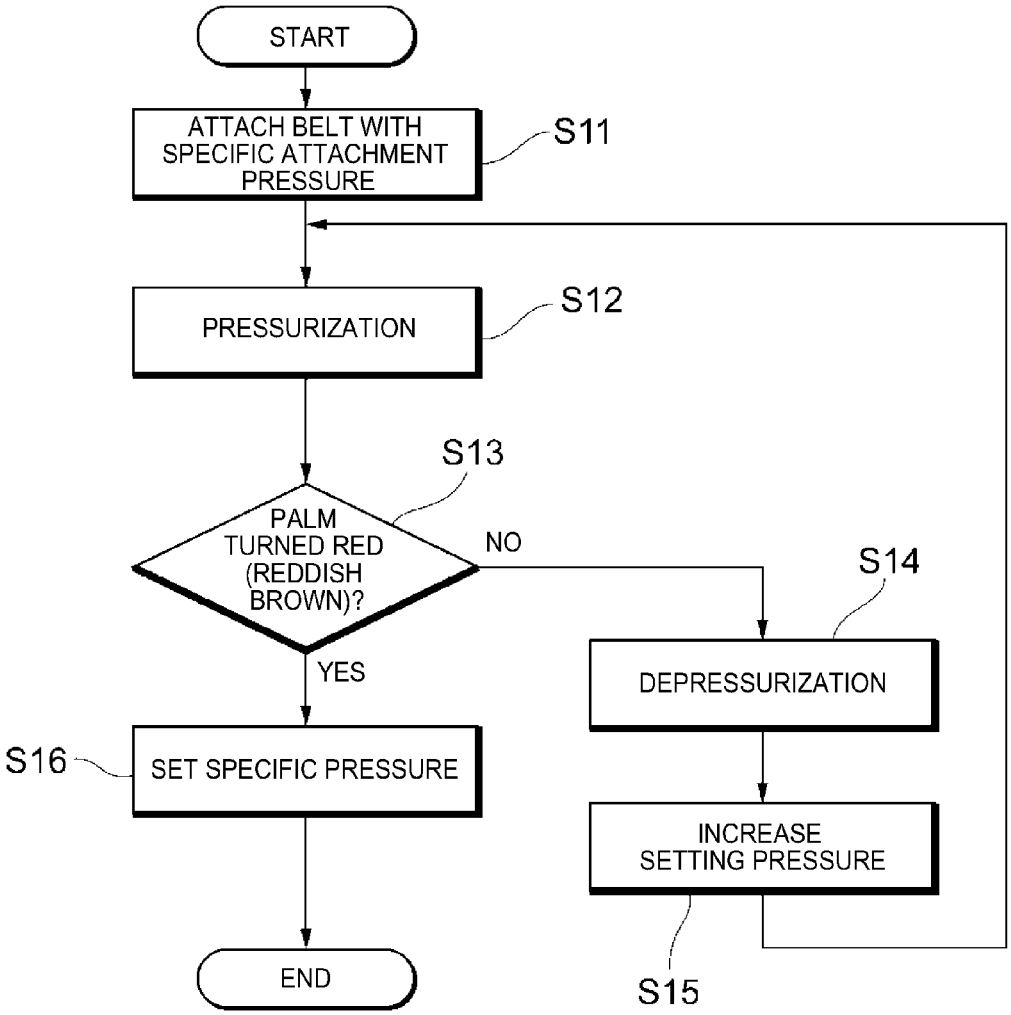
FIG. 7 is a flowchart to describe pressure setting step in the muscle training method according to the first embodiment of the present invention.

As shown in FIG. 7, in the pressure setting step 10, the belt 1 is firstly wound around at least one of four limbs of the user P, and the belt 1 is attached at specific attachment pressure (attachment step: S11). The specific attachment pressure preferably varies with ages of users P or their exercise experiences. For instance, as shown in the table of FIG. 8, when the belt 1 is attached to their arms, and when the user P is elderly (aged 70 or over), the specific attachment pressure may be set at 15 to 20 mmHg, when the person P is middle-aged (aged 50 or over and 69 or under), the specific attachment pressure may be set at 20 to 30 mmHg, and when the person P is general (aged 49 or under), the specific attachment pressure may be set at 30 to 40 mmHg. When the belt 1 is attached to their legs, if the user P is an athlete with a lot of exercise experiences, the specific attachment pressure may be set at 50 to 60 mmHg.

In the attachment step S11, the instructor sets the specific attachment pressure using the input device of the pressure applying/removing controller 100, and activates the control unit 120 of the pressure applying/removing controller 100. Thereby, the control unit 120 drives and controls the pumps 110 so that the pressure in the gas bags (pressure that the belt 1 applies to the muscle) agrees with the specific attachment pressure.

Following the attachment step S11, pressure higher than the specific attachment pressure is applied to the user P (pressurization step: S12). The value of the pressure applied in the first pressurization step S12 is preferably set at a value that is higher than the specific attachment pressure by about 10 mmHg when the belt 1 is to be attached to the arm. When the belt 1 is to be attached to the leg, the pressure is preferably set at a value that is higher than the specific attachment pressure by about 20 mmHg. In this pressurization step S12 as well, the instructor sets the value of the pressure using the input device of the pressure applying/removing controller 100, and activates the control unit 120 of the pressure applying/removing controller 100, whereby the pressure that the belt 1 applies to the muscle can agree with the setting value.

Next, in the pressurization step S12, determination is made whether the palm (or the instep) of the user P turns red or reddish brown or not (determination step: S13). In the determination step S13, when the color of the palm (the instep) of the user P is still pink, the pressure applied in the pressurization step S12 is removed, and the pressure is returned to the specific attachment pressure (depressurization step: S14) and then the setting value of the pressure is increased (setting-pressure increasing step: S15), and thereafter the pressurization step S12 is performed again. The pressure increased in the setting-pressure increasing step S15 is preferably about 10 mmHg when the belt 1 is to be attached to the arm and is about 20 mmHg when the belt 1 is to be attached to the leg. In the depressurization step S14, the instructor uses the input device of the pressure applying/removing controller 100 to let the control unit 120 control to remove pressure, whereby pressure can be removed. In the setting-pressure increasing step S15, the instructor sets the value of pressure using the input device of the pressure applying/removing controller 100 and activates the control unit 120 of the pressure applying/removing controller 100, whereby pressure that the belt 1 applies to the muscle can agree with the setting value.

Subsequently, each of the pressurization step S12, the depressurization step S14 and the setting-pressure increasing step S15 is repeated a plurality of times until the palm (the instep) of the user P turns red or reddish brown in the determination step S13, and when the palm (the instep) of the user P turns red or reddish brown in the determination step S13, the pressure at that time is set as specific pressure (setting step: S16).

The study conducted by the inventor of the present application clarified that the specific pressure set through these steps is substantially within the range of "appropriate pressure" indicated in the table of FIG. 8. For instance, when the belt 1 is to be attached to the arm, and when the user P is elderly (aged 70 or over), the specific pressure set through the above steps is substantially within the range of 40 to 60 mmHg. It should be noted that since the specific pressure may change depending on the physical condition or the like of the user P, the specific pressure should be set through the determination in the determination step S13 (whether the color of the palm of the user P turns red or reddish brown or not), without depending on the value indicated in FIG. 8.

Through the longtime study by the inventor of the present application, it was found that KAATSU training performed at the pressure when the palm (the instep) of the user P turns red or reddish brown yields the best effect of strengthening muscles. The inventor of the present application also found that the pressure when the palm of the user P turns pink is a value lower than the specific pressure, when the palm of the user P turns purple, the state is about to stop the blood flow, and when the palm of the user P turns white, this shows the blood-flow stopping state, meaning that the pressure has to be removed quickly. The inventor of the present application also found that such a method for determining the specific pressure based on the color of the palm can apply to all of the races of the user P.

Such a determination on the color of the palm of the user P may be made visually by the instructor. Alternatively, a device (such as image processing device) to recognize the color of the palm of the user P may be used to determine the color of the palm of the user P.

After setting the specific pressure for the user P through the pressure setting step S10, as shown in FIG. 6, the belt 1 is wound around at least one of four limbs of the user P for attachment (belt attachment step: S20). Then the specific pressure set at the pressure setting step S10 is applied to the user P so as to restrict the blood circulation of a muscle of the user P without stopping it, and in this state the user P is asked to perform load-applied exercise to apply the load of a specific weight to the muscle of the user P (first pressuring and exercise step: S30). In this first pressuring and exercise step S30, the instructor sets the specific pressure using the input device of the pressure applying/removing controller 100, and activates the control unit 120 of the pressure applying/removing controller 100, whereby the pressure that the belt 1 applies to the muscle can agree with the set specific pressure.

Examples of the load-applied exercise include, for arms, for example, dumbbell curl exercise to raise a dumbbell D (FIG. 4) carried by one arm, and bench press exercise to press a barbell upwards by both hands while keeping a supine posture. The specific weight applied to the muscle of the user P (e.g., in the case of dumbbell curl exercise as load-applied exercise, the weight of the dumbbell) is set at a value smaller than the maximum weight necessary for the user P to exert the maximum muscle force (the weight at which the user P can perform load-applied exercise only once). Especially the specific weight is preferably set at a value of 20 to 30% of the maximum weight.

The number of load-applied exercise performed in the first pressuring and exercise step S30 (e.g., in the case of dumbbell curl exercise as load-applied exercise, the number of lifting the dumbbell) is preferably set at 20 to 60 times, and at 25 to 30 times more preferably. The number of load-applied exercise performed in the first pressuring and exercise step S30 is set more than the number of load-applied exercise performed in a second pressuring and exercise step S50 or later, which will be described later.

The first pressuring and exercise step S30 is a step for preliminary exercise to create the environment to increase the level of lactic acid in the blood. The inventor of the present application found that, when the user P is a non-athlete (person with relatively less exercise experiences), and the user is asked to perform the load-applied exercise about 25 to 30 times while receiving the specified pressure, then an enough level of lactic acid in the blood can be achieved. On the contrary, when the user P is an athlete with a lot of exercise experiences, an enough level of lactic acid in the blood cannot be achieved in some cases unless they perform the load-applied exercise a relatively large number of times while receiving the specified pressure. Such an athlete is asked to perform the load-applied exercise about 40 to 60 times.

After the first pressuring and exercise step S30, the user is asked to stop the load-applied exercise while continuously receiving the specified pressure (first exercise stopping step: S40). When the specific pressure is applied to arms in the first pressuring and exercise step S30, the stopping duration of the load-applied exercise in the first exercise stopping step S40 is preferably set at 10 to 20 seconds (e.g., 15 seconds). On the contrary, when the specific pressure is applied to legs in the first pressuring and exercise step S30, the stopping duration of the load-applied exercise in the first exercise stopping step S40 is preferably set at 25 to 35 seconds (e.g., 30 seconds).

After the first exercise stopping step S40, the user P is asked to perform the load-applied exercise to apply the load of the specified weight to the muscle of the user P while applying the specific pressure to the user P similarly to the first pressuring and exercise step S30 (second pressuring and exercise step S50). The number of load-applied exercise performed in the second pressuring and exercise step S50 is preferably set at ½ or less of the number of the load-applied exercise performed in the first pressuring and exercise step S30 (e.g., 12 to 15 times). After the second pressuring and exercise step S50, the user is asked to stop the load-applied exercise while continuously receiving the specified pressure (second exercise stopping step: S60). The stopping duration of the load-applied exercise in the second exercise stopping step S60 is set similarly to the first exercise stopping step S40.

After the second exercise stopping step S60, the user P is asked to perform the load-applied exercise to apply the load of the specified weight to the muscle of the user P while applying the specific pressure to the user P similarly to the first pressuring and exercise step S30 (third pressuring and exercise step S70). The number of load-applied exercise performed in the third pressuring and exercise step S70 is preferably set at ½ or less of the number of the load-applied exercise performed in the second pressuring and exercise step S50 (e.g., 7 to 8 times). After the third pressuring and exercise step S70, the user is asked to stop the load-applied exercise while continuously receiving the specified pressure (third exercise stopping step: S80). The stopping duration of the load-applied exercise in the third exercise stopping step S80 is set similarly to the first exercise stopping step S40.

After the third exercise stopping step S80, the user P is asked to perform the load-applied exercise to apply the load of the specified weight to the muscle of the user P while applying the specific pressure to the user P similarly to the first pressuring and exercise step S30 (fourth pressuring and exercise step S90). The number of load-applied exercise performed in the fourth pressuring and exercise step S90 is preferably set at ½ or less of the number of the load-applied exercise performed in the third pressuring and exercise step S70 (e.g., 2 to 3 times). After the fourth pressuring and exercise step S90, the user is asked to stop the load-applied exercise while continuously receiving the specified pressure (fourth exercise stopping step: S100). The stopping duration of the load-applied exercise in the fourth exercise stopping step S100 is set similarly to the first exercise stopping step S40. Subsequently the belt 1 is removed from the user P (belt removal step: S110) to complete the KAATSU training.

In the muscle training method according to the embodiment as stated above, the specific pressure is applied to at least one of four limbs of the user P in the pressurization steps (S30, S50, S70 and S90) so as to restrict the blood circulation at the muscle of the user P without stopping it, and in this state the user P is allowed to perform the load-applied exercise to apply the specific weight to the muscle of the user P. At this time, the specific weight is set at a value smaller than the maximum weight necessary for the user P to exert the maximum muscle force, which can prevent the excess load from being applied to the user P and so prevent injuries or the like. In the pressurization steps (S30, S50, S70 and S90), the blood circulation at the muscle of the user P is restricted appropriately through the application of the specific pressure, and so the level of lactic acid in the blood can be increased compared with the state without the specific pressure being applied, and as a result, growth hormones can be produced more, so that higher effect of strengthening the muscle can be obtained even from relatively light load. Further in the exercise stopping steps (S40, S60, S80 and S100), the appropriate restriction of the blood circulation by the application of the specific pressure can be continued during the stopping of the load-applied exercise as well, and therefore the state of keeping the level of lactic acid in the blood actually can be created purposefully even though the user appears stopping the exercise, and as a result, high effect of strengthening the muscle can be obtained.

In the muscle training method according to the embodiment as stated above, the specific weight used in the pressurization steps (S30, S50, S70 and S90) is set at 20 to 30% of the maximum weight, and therefore higher effect of strengthening the muscle can be obtained. In common muscle training, the user P is generally asked to perform the load-applied exercise a plurality of times to apply the load that is 70 to 80% of the maximum weight, and it has been found recently that such load applied cannot increase the level of lactic acid in the blood effectively considering (physical/mental) pain that the user P suffers from. The inventor of the present application found that the combination of appropriate blood circulation restriction through the application of specific pressure and the load-applied exercise with relatively light load (load that is 20 to 30% of the maximum weight) enables an effective increase in the level of lactic acid in the blood while reducing pain of the user P.

In the muscle training method according to the embodiment as stated above, the number of the load-applied exercise performed in the first pressuring and exercise step S30 is set more than the number of the load-applied exercise performed in the second pressuring and exercise step S50. Thereby, the level of lactic acid in the blood can be increased very effectively from the very beginning of performing of the present method, and so the effect of strengthening muscles can be increased more.

In the muscle training method according to the embodiment as stated above, in the case of applying the specific pressure to an arm of the user P, the stopping duration of the load-applied exercise is set at the specific duration (10 to 20 seconds), whereby higher effect of strengthening the muscle can be obtained. If the stopping duration of the load-applied exercise is less than 10 seconds when the specific pressure is applied to an arm, the user P does not feel like pausing and so is not inspired to perform the following load-applied exercise. If the stopping duration of the load-applied exercise exceeds 20 seconds, this means that the blood-circulation restriction state lasts relatively long, and so the subsequent load-applied exercise becomes physically difficult, and so both of these durations are not preferable. In the case of applying the specific pressure to a leg of the user P, the stopping duration of the load-applied exercise is set at the specific duration (25 to 35 seconds), whereby higher effect of strengthening the muscle can be obtained. If the stopping duration of the load-applied exercise is less than 25 seconds when the specific pressure is applied to a leg, the user P does not feel like pausing and so is not inspired to perform the following load-applied exercise. If the stopping duration of the load-applied exercise exceeds 35 seconds, this means that the blood-circulation restriction state lasts relatively long, and so the subsequent load-applied exercise becomes physically difficult, and so both of these durations are not preferable.

In the muscle training method according to the embodiment as stated above, appropriate specific pressure can be set safely for the user P while considering individual differences and the physical condition or the like of the user P. Further when the appropriate specific pressure is found, pressurization and depressurization are repeated while increasing the setting pressure from lower pressure gradually, whereby blood vessels can be strengthened in the process. The inventor of the present application found through longtime study that specific load-applied exercise with the pressure when the palm of the user P turns red or reddish brown can lead to the best effect of strengthening the muscle. In the present method, the pressure when the palm of the user P turns red or reddish brown is set as the specific pressure, whereby high effect of strengthening muscles can be obtained.

Second Embodiment

Next referring to FIGS. 9 to 24, the following describes a muscle training method (KAATSU training) according to a second embodiment of the present invention. The KAATSU training according to the present embodiment is performed using a device (muscle training system including an attachment-type controller 100A) that is different from the pressure applying/removing controller 100 used in the first embodiment. In the present embodiment, the configuration of this system is mainly described, and the same reference numerals as those in the first embodiment are assigned to the configuration common to the first embodiment and the detailed descriptions are omitted.

Figure 9:
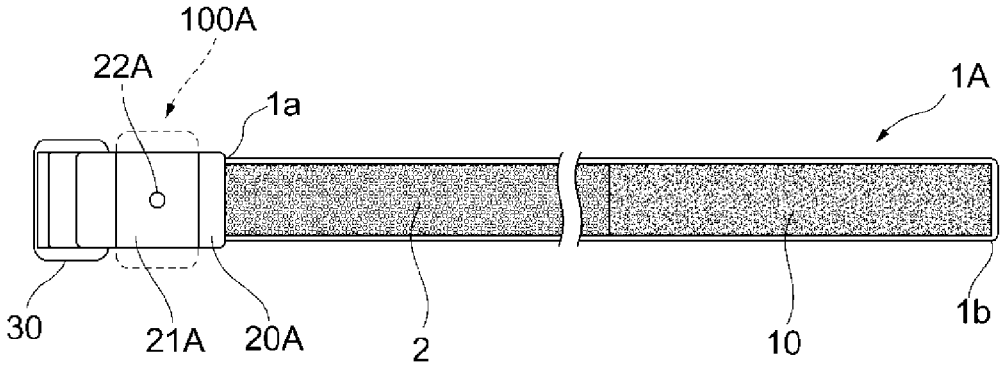
FIG. 9 is a plan view (showing an outer face) of the belt used in a muscle training method according to a second embodiment of the present invention.
Figure 10A:
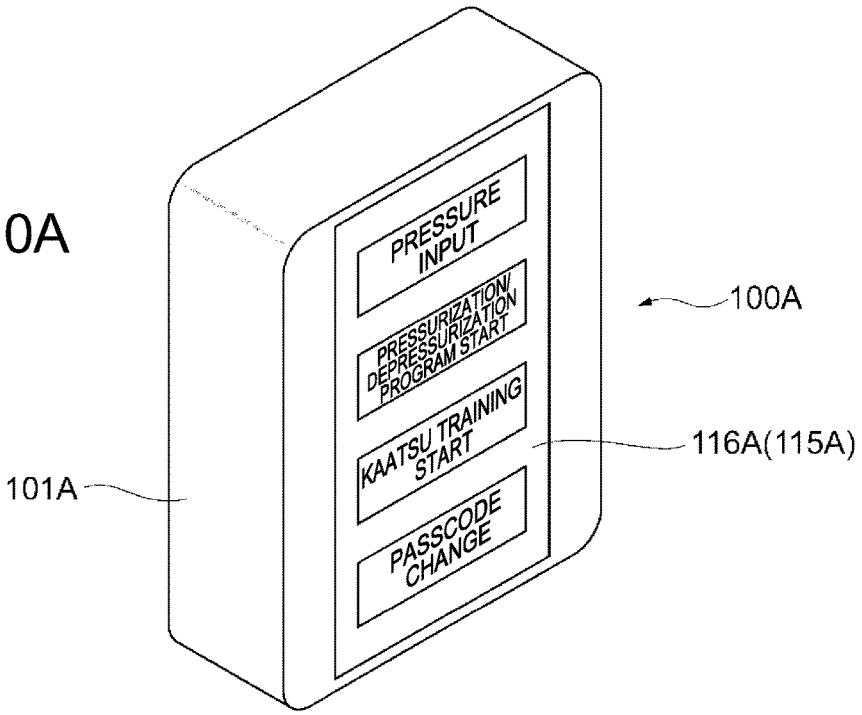
FIG. 10 shows the appearance of an attachment-type controller used in the muscle training method according to the second embodiment of the present invention, where (A) is a perspective view from the surface and (B) is a perspective view from the rear face.
Figure 10B:
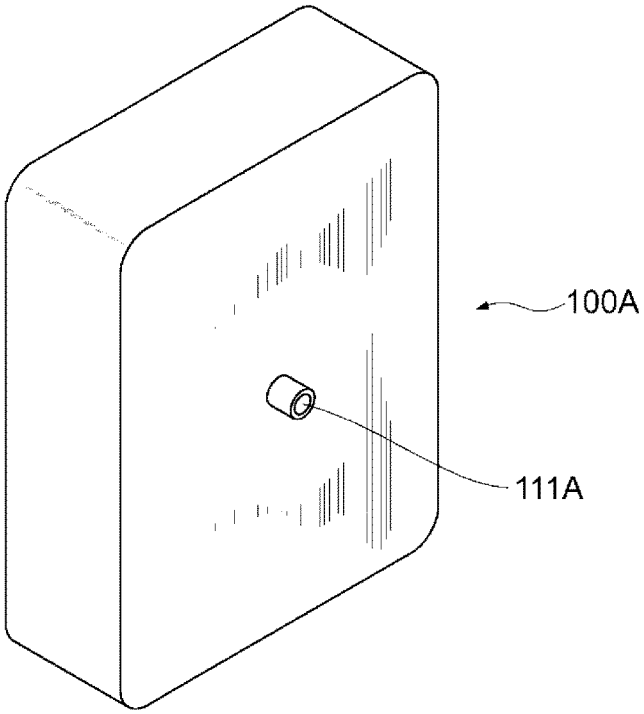
Figure 11:
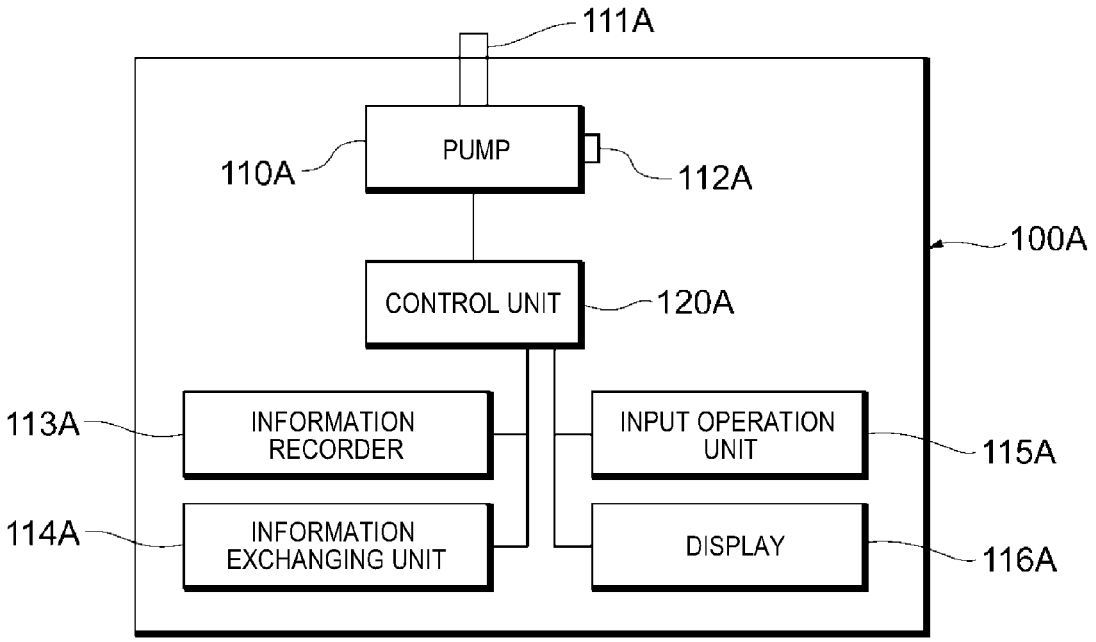
FIG. 11 is a block diagram showing the functional configuration of an attachment-type controller used in the muscle training method according to the second embodiment of the present invention.

Referring to FIGS. 9 to 11, the configuration of the muscle training system used in the KAATSU training according to the present embodiment is firstly described. The muscle training system in the present embodiment includes a belt 1A and an attachment-type controller 100A. FIG. 9 shows an outer face (exposed to the outside) of the belt 1A. Similarly to the belt 1 in the first embodiment, the belt 1A in the present embodiment is a belt-like member that is wound around at least one of four limbs of a user to apply pressure to a muscle, and is internally provided with a gas bag not illustrated. Materials of the belt 1A and the gas bag and the widths and lengths of the belt 1A and the gas bag are similar to those in the first embodiment, and so their detailed descriptions are omitted.

The belt 1A is provided with a hook-and-loop fastener 10 on the outer face similarly to the belt 1 in the first embodiment. The belt 1A has one end 1*a*, to which a buckle 30 is attached via a coupling member 20A. The buckle 30 is similar to that in the first embodiment. The coupling member 20A is a member to couple the one end 1*a* of the belt 1A and the buckle 30, which is made of a material having flexibility, such as artificial leather, similarly to the first embodiment. As shown in FIG. 9, the coupling member 20A in the present embodiment is provided with an attachment part 21A, to which the attachment-type controller 100A is to be attached, and the attachment part 21A is provided with a belt-side connecting port 22A, to which a connecting port 111A (FIG. 10(B)) of the attachment-type controller 100A is to be connected. The belt-side connecting port 22A is in communication with the interior of the gas bag, and as described below, gas (air in the present embodiment) is fed into the gas bag through this belt-side connecting port 22A, or the gas in the gas bag goes out to the outside through this.

When the belt 1A for arm is attached to the base of an arm of the user, for example, similarly to the first embodiment (FIG. 4), the belt 1A is firstly wound around the base (specific part) of the arm to from a loop shape, and then the other end 1*b* of the belt 1A is passed through the buckle 30 attached to the one end 1*a* of the belt 1A and then the belt 1A is folded back, and then the belt 1A is tightened while holding the other end 1*b* of the belt 1A passed through the buckle 30. Then, while applying predetermined pressure by tightening the belt 1A, the loop shape of the belt 1A is kept using the hook-and-loop fastener 10. Thereby, the belt 1A can be attached to the base of the arm of the user while applying the predetermined pressure to a desired muscle. When air is sent into the gas bag air while having the user attached with the belt 1A to the base (specific part) of the arm, then the belt 1A tightens the muscle and applies pressure thereto. Conversely, when air is pulled out of the gas bag in this state, pressure applied to the muscle from the belt 1A is reduced.

The attachment-type controller 100A is configured, similarly to the pressure applying/removing controller 100 in the first embodiment, to control the amount of gas supplied to and discharged from the gas bag provided in the belt 1A, whereby pressure applied to the specific part of the user from the belt 1A can be controlled. FIG. 10(A) is a perspective view of the attachment-type controller 100A viewed from the surface (from a display 116A) in the present embodiment, and (B) is a perspective view of the attachment-type controller 100A viewed from the rear face (from the connecting port 111A). FIG. 11 is a block diagram showing the functional configuration of the attachment-type controller 100A in the present embodiment.

As shown in FIG. 11, the attachment-type controller 100A includes a supplying/discharging control unit (pump 110A and a control unit 120A) to control the amount of gas supplied to or discharged from the gas bag of the belt 1A so as to apply specific pressure to the specific part from the belt 1A in the muscle training method (KAATSU training) according to the present embodiment. The pump 110A and the control unit 120A are stored in a case 101A having a substantially rectangular parallelepiped shape as shown in FIG. 10. The case 101A has a size enabling the attachment to the attachment part 21A of the belt 1A (e.g., 7 to 8 cm in length, about 4 to 5 cm in width, and about 2 to 3 cm in thickness). The shape of the case 101A is not limited to a rectangular parallelepiped shape, which may be of other shapes enabling the attachment to the belt 1A.

Similarly to the pumps 110 in the first embodiment, the pump 110A in the attachment-type controller 100A has a function to draw gas around it (air in the present embodiment) and send the gas to the outside via the connecting port 111A. The pump 110A is provided with a valve 112A as well, and releasing of the valve 112A allows gas inside of the pump 110A to be discharged to the outside. The pump 110A is provided with the connecting port 111A (FIG. 10(B)), and is connected to the gas bag provided in the belt 1A via the belt-side connecting port 22A (FIG. 9) connected thereto. When the pump 110A sends gas, the gas can be fed into the gas bag, and when the pump 110A releases the valve 112A, the gas can be removed from the gas bag. Note here that the valve 112A does not always have to be provided at the pump 110A, which may be provided at any part on the route from the pump 110A to the gas bag. The pump 110A is provided with a not-illustrated pressure indicator built therein, with which the pressure in the pump 110A can be measured. The pressure in the pump 110A is naturally equal to the pressure in the gas bag. This pressure in the gas bag corresponds to the pressure that the belt 1A applies to a muscle.

The control unit 120A in the attachment-type controller 100A controls the pump 110A. The control unit 120A controls the pump by driving the pump 110A while closing the valve 112A to send air to the gas bags of the belts 1A, or by releasing the valve 112A of the pump 110A to remove air in the gas bags, so that the pressure in the pump 110A measured by the pressure indicator becomes a predetermined setting value. That is, the control unit 120A is configured to control the pump 110A, including the opening/closing of the valve 112A.

As shown in FIG. 11, the attachment-type controller 100A includes an information recorder 113A to record various types of information therein. The information recorder 113A is configured to enable recording of various types of information, such as specific pressure for each user, or to enable deletion of the recorded information. The control unit 120A can control the amount of gas supplied to and discharged from the gas bag of the belt 1A so that the specific pressure read from the information recorder 113A can be applied to the specific part from the belt 1A.

In the present embodiment, a memory card that is detachable from the case 101A is used as the information recorder 113A. The memory card as the information recorder 113A is removed from the case 101A, specific pressure is written on the memory card using an external device (main unit) not illustrated, and then the memory card with the specific pressure written thereon can be attached to the case 101A. The specific pressure therefore can be updated as needed.

As shown in FIG. 11, the attachment-type controller 100A includes an information exchanging unit 114A to transmit and receive various types of information. The information exchanging unit 114A is configured to receive various types of information, such as specific pressure, set at the external device not illustrated, or to transmit various types of information, such as history of KAATSU training performed, to the external device. The information recorder 113A can store various types of information, such as specific pressure, received by the information exchanging unit 114A.

As shown in FIG. 11, the attachment-type controller 100A includes an input operation unit 115A to input various types of information. The input operation unit 115A is to input various operation instructions and to input various types of information, such as specific pressure. The information recorder 113A can store various types of information, such as specific pressure, input through the input operation unit 115A. The control unit 120A can control the amount of gas supplied to and discharged from the gas bag of the belt 1A so that the specific pressure input through the input operation unit 115A can be applied to the specific part from the belt 1A.

As shown in FIG. 11, the attachment-type controller 100A includes a display 116A to visually display (output) various types of information. The display 116A is to display various types of information, such as specific pressure, input through the input operation unit 115A. In the present embodiment, a display screen displayed on one surface of the case 101A is used as the display 116A as shown in FIG. 10(A). This display screen is a touch panel that functions as the input operation unit 115A as well. Instead of the display 116A (or in addition to the display 116A) to visually display various types of information, a sound output unit to output various types of information by sounds can be provided. The input operation unit 115A, which can input various operation instructions by sounds, may be used.

The attachment-type controller 100A is configured to control the pressure applied to the specific part from the belt 1A so that pressurization operation to apply predetermined pressure to the specific part and depressurization operation to remove the pressure applied to the specific part in the pressurization operation are repeated alternately. Specifically, receiving a predetermined operation instruction, the control unit 120A of the attachment-type controller 100A can drive and control the pump 110A to feed gas to the gas bag (pressurization operation) and to release the valve 112A to remove gas from the gas bag (depressurization operation). The attachment-type controller 100A is configured to, when the pressurization operation is performed a plurality of times, set the pressure in each pressurization operation higher than the pressure in the preceding pressurization operation.

Next, referring to FIGS. 12 to 24, the following describes a muscle training method (KAATSU training) using the muscle training system according to the present embodiment.

Similarly to the first embodiment, the muscle training method (KAATSU training) according to the present embodiment is a method, in which a pressuring and exercise step (FIG. 12, 530A or the like) and an exercise stopping step (FIG. 12, 540A or the like) are repeated alternately to strengthen a muscle of a user, in the pressuring and exercise step, the belt 1A is wound around at least one of four limbs of the user to apply specific pressure thereto so as to restrict the blood circulation at a muscle of the user without stopping it, and then the user P is asked to perform load-applied exercise a plurality of times to apply the load of specific weight to the muscle to the user, and in the exercise stopping step, load-applied exercise is stopped while continuing the application of the specific pressure. The following describes each step specifically.

Firstly, before performing the pressuring and exercise step (FIG. 12, 530A or the like), the instructor of KAATSU training sets specific pressure to be applied to at least one of four limbs of the user (pressure setting step: S10A). In the pressure setting step S10A in the present embodiment, the same steps or the like as in the pressure setting step S10 (FIG. 7) in the first embodiment are used so as to set the specific pressure for each user beforehand.

Figure 12:
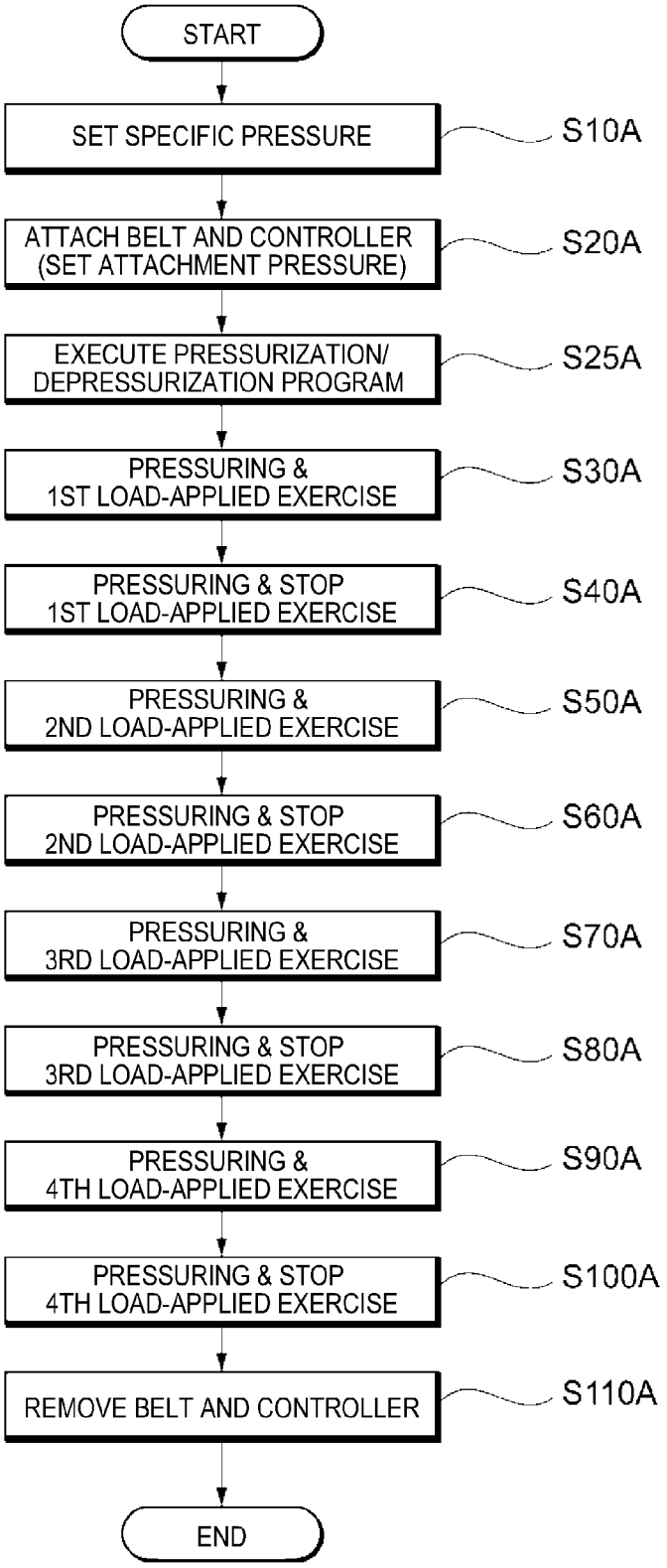
FIG. 12 is a flowchart to describe the muscle training method according to the second embodiment of the present invention.

Following the pressure setting step S10A, the instructor winds the belt 1A around at least one of four limbs of the user for attachment, and attaches the attachment-type controller 100A to the attachment part 21A of the belt 1A (FIG. 12, system attachment step: S20A). In the system attachment step S20A, the connecting port 111A of the attachment-type controller 100A is connected to the belt-side connecting port 22A of the belt 1A. In the system attachment step S20A, the instructor checks whether the belt 1A is attached or not to the user with appropriate attachment pressure as shown in FIG. 8 of the first embodiment, for example, and if the attachment pressure is not appropriate, the instructor sets the attachment pressure to be an appropriate value, and inputs the specific pressure set in the pressure setting step S10A to the attachment-type controller 100A. Referring to FIGS. 13 to 16, the following describes the procedure to check and set the attachment pressure and input the specific pressure.

Figure 13:
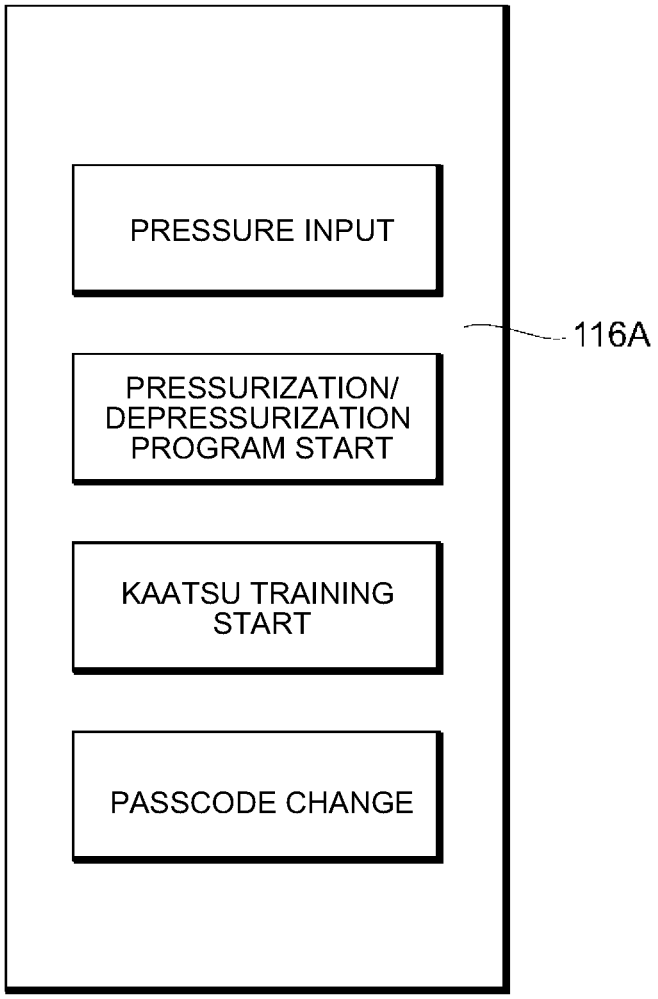
FIG. 13 shows a menu screen displayed on a display of the attachment-type controller used in the muscle training method according to the second embodiment of the present invention.
Figure 14:
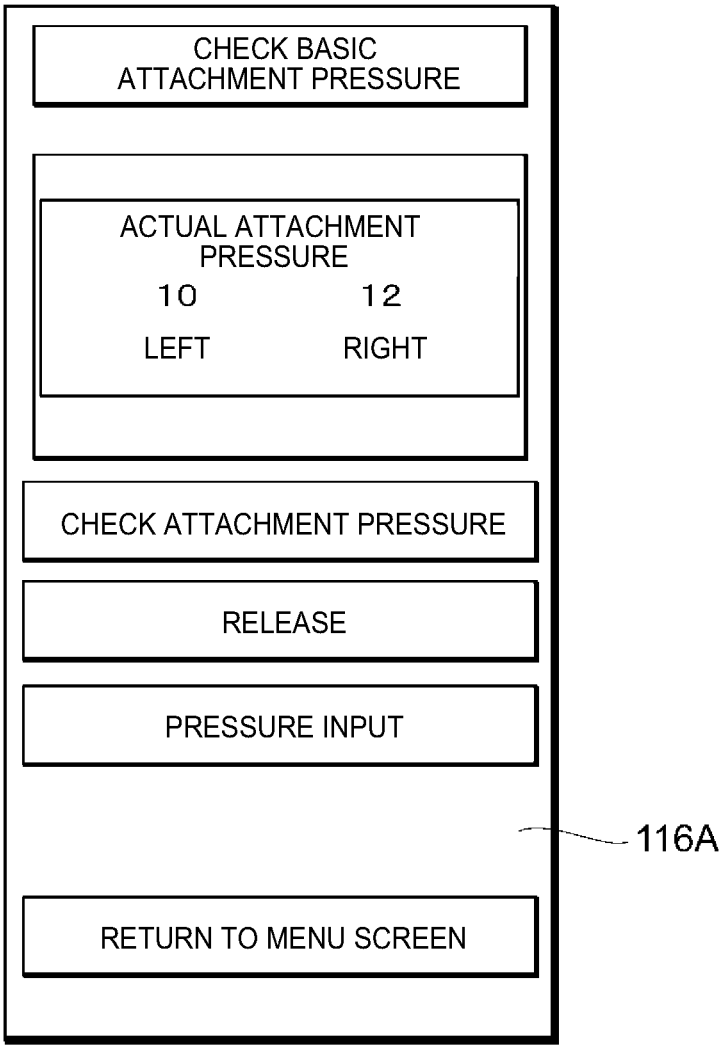
FIG. 14 shows an attachment pressure confirmation screen displayed on a display of the attachment-type controller used in the muscle training method according to the second embodiment of the present invention.

FIG. 13 shows a menu screen displayed on the display 116A of the attachment-type controller 100A. This menu screen that functions as the input operation unit 115A (touch panel) as well displays buttons for input operation, named "pressure input" "pressurization/depressurization program start", "KAATSU training start" and "passcode change". Among these buttons, when the "pressure input" button is pressed, the attachment pressure confirmation screen shown in FIG. 14 is displayed. When the button for input operation named "attachment pressure check" on the screen of FIG. 14 is pressed, the current attachment pressure of the belt 1A (the value measured by the pressure indicator of the attachment-type controller 100A) is displayed inside of a monitor frame indicated as "actual attachment pressure". The example of FIG. 14 displays the actual attachment pressure for the left arm as 10 mmHg, and the actual attachment pressure for the right arm as 12 mmHg. If the actual attachment pressure displayed is lower than the appropriate value, the instructor tightens the belt 1A again to increase the attachment pressure to the appropriate value. On the contrary, when the actual attachment pressure displayed is higher than the appropriate value, the instructor presses the button for input operation, named "release" in the screen of FIG. 14 to release the valve 112A of the attachment-type controller 100A to remove air and to decrease the attachment pressure to the appropriate value.

Figure 15:
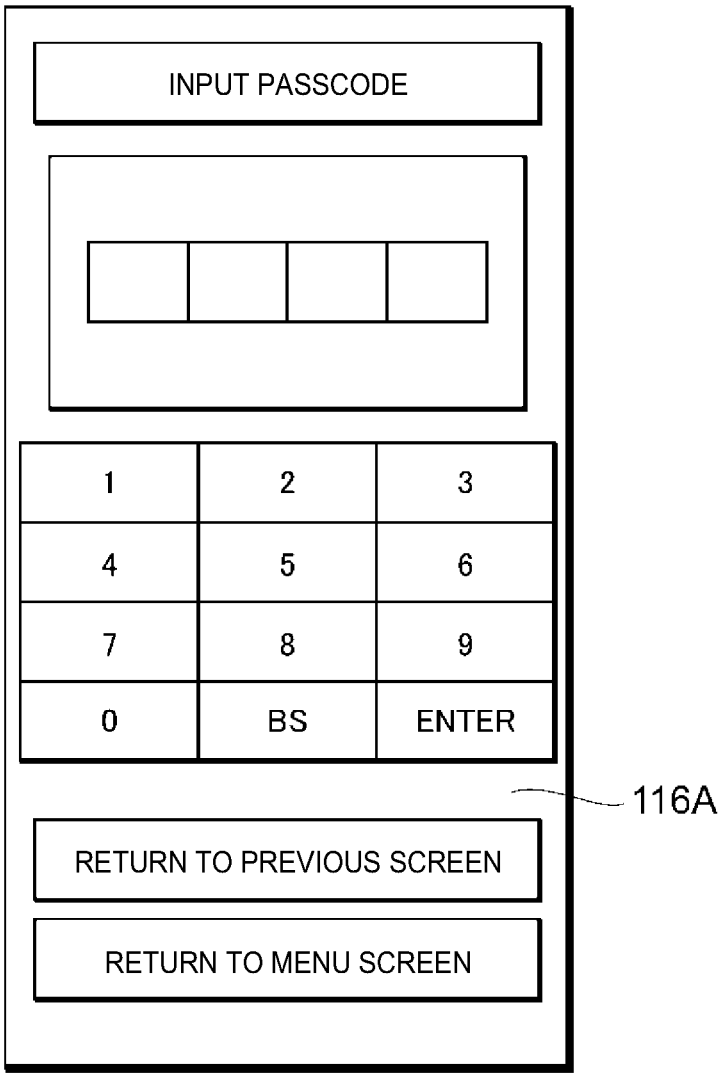
FIG. 15 shows a passcode input screen displayed on a display of the attachment-type controller used in the muscle training method according to the second embodiment of the present invention.
Figure 16:
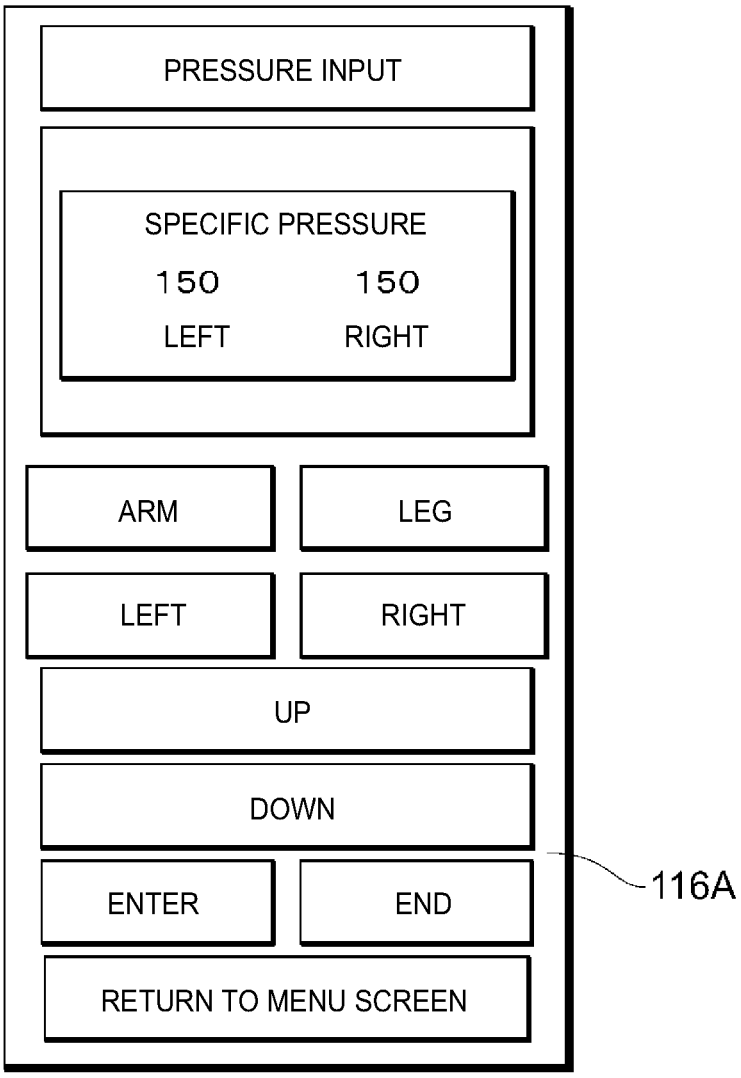
FIG. 16 shows a pressure input screen displayed on a display of the attachment-type controller used in the muscle training method according to the second embodiment of the present invention.

After setting the attachment pressure at the appropriate value through the above procedure, when the instructor presses the button for input operation, named "pressure input" on the screen of FIG. 14, then a passcode input screen shown in FIG. 15 is displayed. When the instructor inputs the passcode assigned to them by manipulating numeric keypads displayed on the screen of FIG. 15, then a pressure input screen shown in FIG. 16 is displayed. The screen in FIG. 16 displays buttons for input operation, named "arms", "legs", "left" and "right", and the instructor can select them appropriately and press to select the part as an input target (e.g., right arm). Then the instructor presses the buttons named "up" and "down" on the screen in FIG. 16 to input the specific pressure for each part as the input target. In the example of FIG. 16, 150 mmHg is input for both of the specific pressures of the left arm. When inputting of the specific pressure for a certain target part is finished, the instructor presses the button for input operation, named "enter" on the screen of FIG. 16, and then inputs the specific pressure for the next specific part. Then, when inputting of the specific pressure for all of the target parts is finished, the instructor presses the button for input operation, named "end" in the screen of FIG. 16 to end the input of the specific pressure. When the "end" button in FIG. 16 is pressed, then a menu screen in FIG. 13 is displayed. The input specific pressure is recorded on the information recorder 113A of the attachment-type controller 100A, which is then used in the pressing and exercise step described later.

Following the belt/controller attachment step S20A, "pressurization/depressurization program" is performed that is warmup exercise of the KAATSU training (FIG. 12, pressurization/depressurization step: S25A). Referring to FIG. 13 and FIGS. 17 to 21, the following describes the procedure to perform the pressurization/depressurization step S25A.

Figure 17:
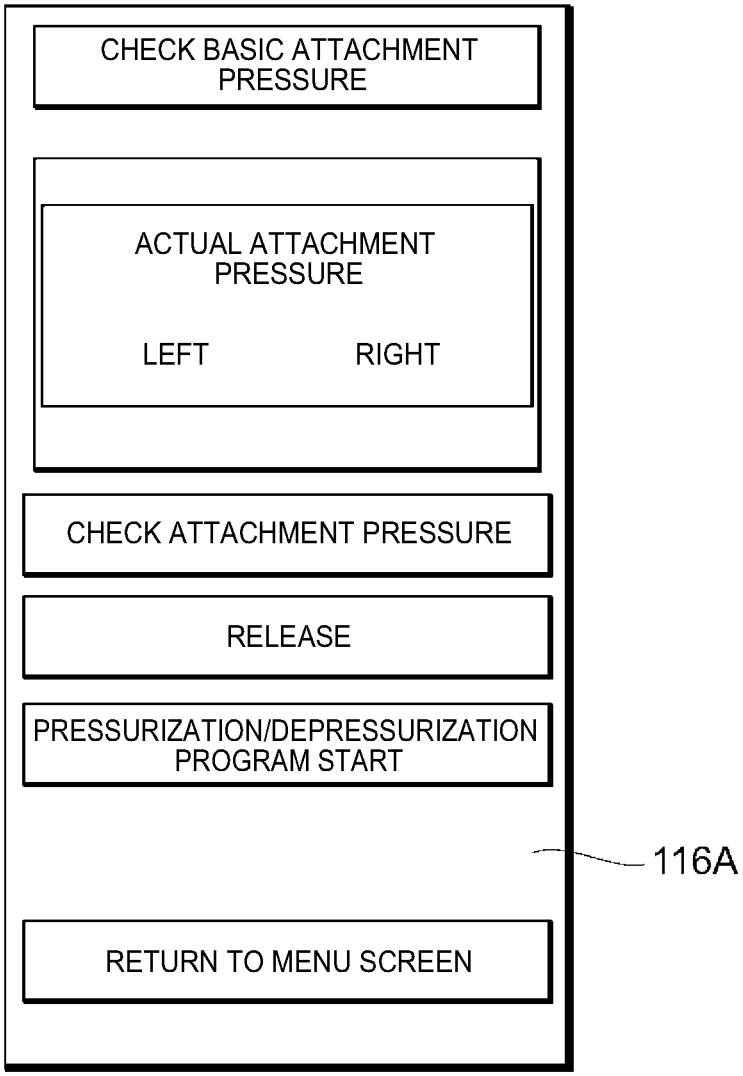
FIG. 17 shows an attachment pressure confirmation screen displayed on a display of the attachment-type controller used in the muscle training method according to the second embodiment of the present invention.
Figure 18:
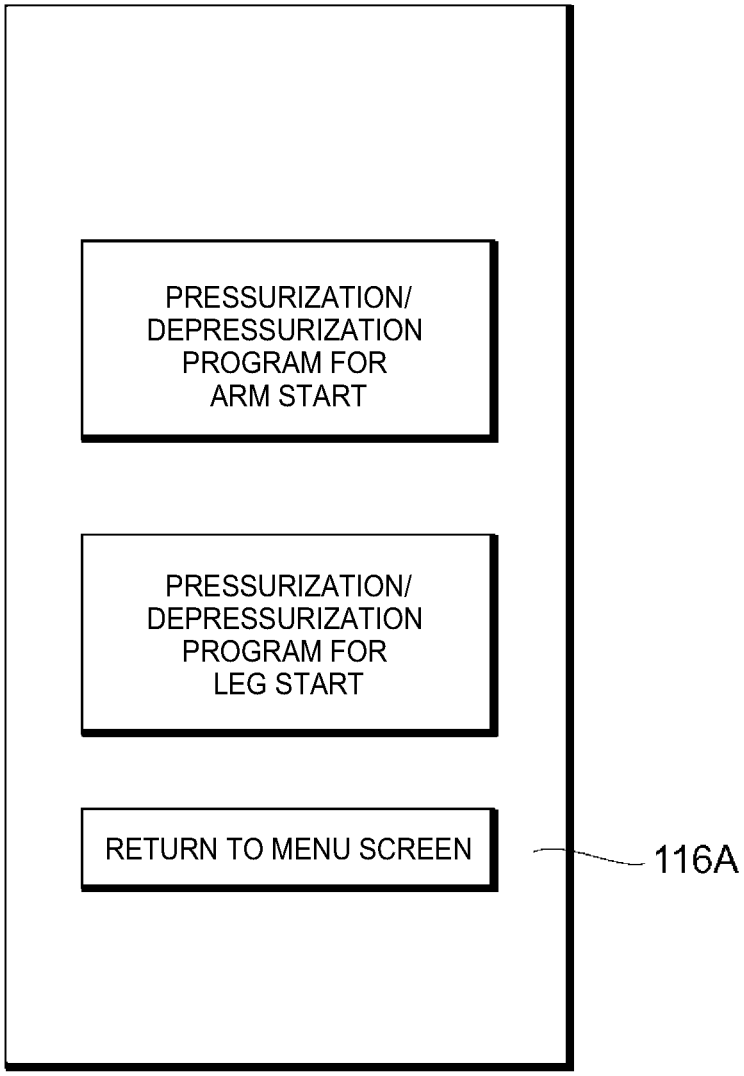
FIG. 18 shows a sub-menu screen displayed on a display of the attachment-type controller used in the muscle training method according to the second embodiment of the present invention.
Figure 19:
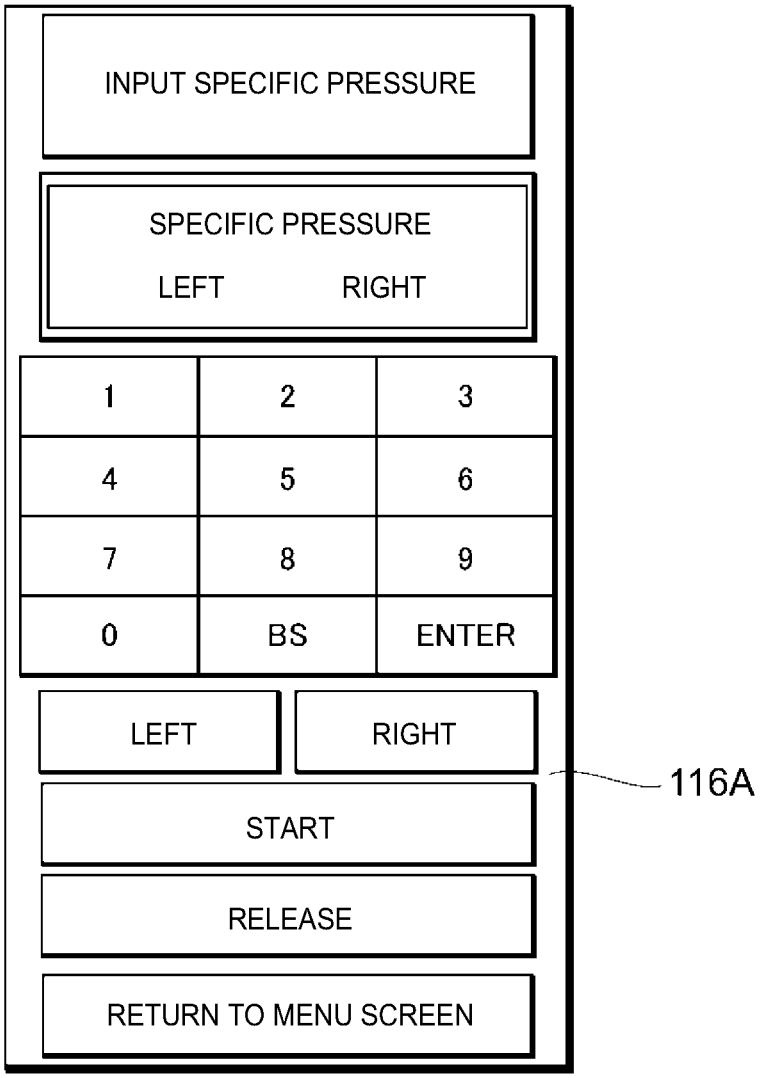
FIG. 19 shows a specific pressure input screen for arms displayed on a display of the attachment-type controller used in the muscle training method according to the second embodiment of the present invention.

Firstly, the "pressurization/depressurization program start" button on the menu screen in FIG. 13 is pressed to display a screen for checking attachment pressure shown in FIG. 17. In the screen for checking attachment pressure in FIG. 17, similarly to the screen in FIG. 14, when the button for input operation, named "attachment pressure confirmation" is pressed, then the current attachment pressure of the belt 1A is displayed inside of a monitor frame indicated as "actual attachment pressure". When the button for input operation, named "pressurization/depressurization program start" in the screen of FIG. 17 is pressed, a sub-menu screen shown in FIG. 18 is displayed. When the instructor presses the button for input operation, named "pressurization/depressurization program start for arms" on the screen of FIG. 18, then a specific pressure input screen for arms shown in FIG. 19 is displayed. The instructor can select "left" and "right" buttons in the screen of FIG. 19 appropriately and press them to select a part as an input target (e.g., right arm). Then, the instructor presses numeric keypads displayed on the screen of FIG. 19 to input specific pressure for each part as input target. The thus input specific pressure is displayed inside of the monitor frame displayed as "specific pressure" in FIG. 19. Subsequently when the instructor presses the button for input operation, named "start" in the screen of FIG. 19, a pressurization/depressurization program screen for arms shown in FIG. 20 is displayed.

Figure 20:
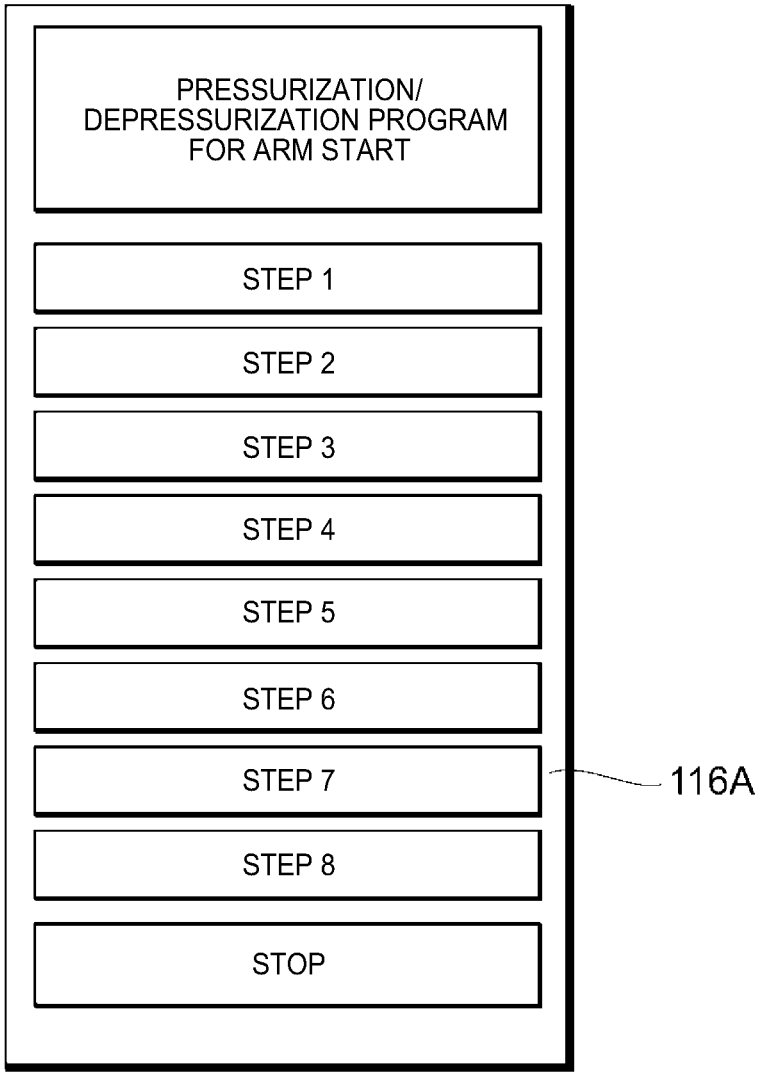
FIG. 20 shows a pressurization/depressurization program screen for arms displayed on a display of the attachment-type controller used in the muscle training method according to the second embodiment of the present invention.
Figure 21:
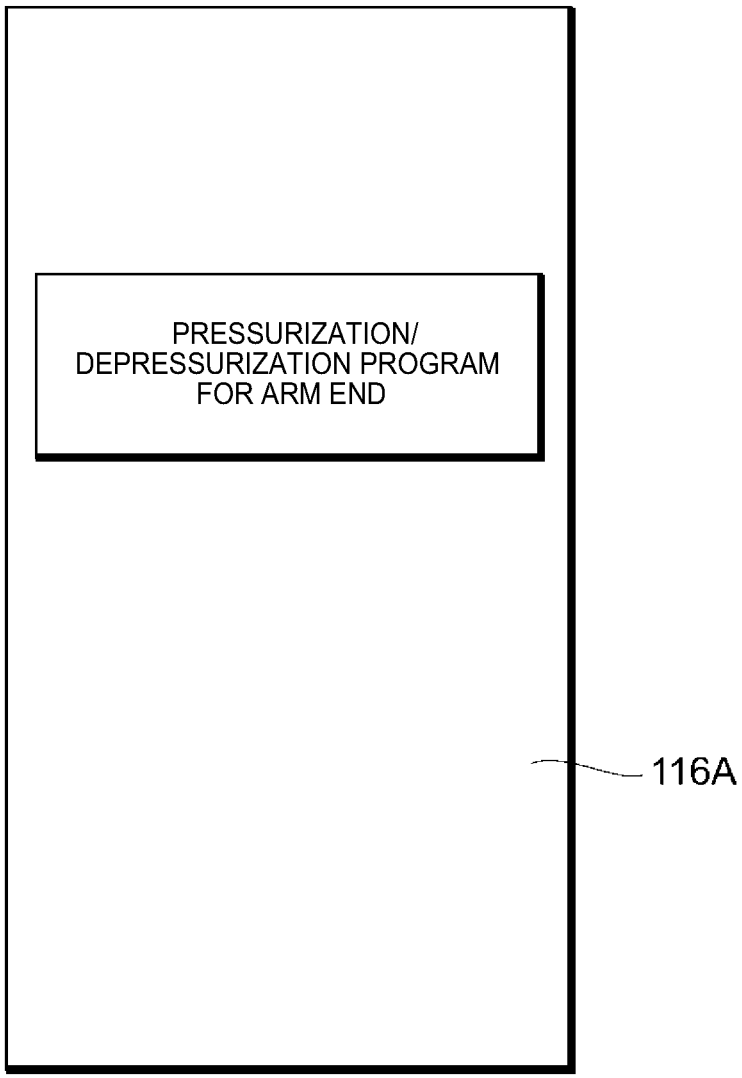
FIG. 21 shows a pressurization/depressurization program end screen for arms displayed on a display of the attachment-type controller used in the muscle training method according to the second embodiment of the present invention.

When the pressurization/depressurization program screen for arms shown in FIG. 20 is displayed, the control unit 120A of the attachment-type controller 100A controls the pump 110A and the valve 112A so as to repeat pressurization and depressurization alternately a plurality of times. For instance, when the specific pressure for arms of a user is input as 150 mmHg, the control unit 120A performs pressurization for a certain time duration (e.g., 10 to 20 seconds) while setting the pressure the first time at 70 mmHg automatically, and then removes the pressure to return the pressure to the attachment pressure (step 1). Then, the control unit 120A performs pressurization for a certain time duration while setting the pressure the second time at 80 mmHg, and then removes the pressure to return the pressure to the attachment pressure (step 2). In this way, the control unit 120A repeats pressurization and depressurization until the eighth time while increasing the pressure by 10 mmHg for each time (steps 3 to 8). The pressure the eighth time is the same as the input specific pressure (150 mmHg). When pressurization the eighth time is finished, the control unit 120A automatically displays an end screen shown in FIG. 21 to inform the user and the instructor of the ending of the pressurization/depressurization program. A pressurization/depressurization program for legs also can be performed similarly.

Following the pressurization/depressurization step S25A, the pressuring and exercise step (FIG. 12, S30A or the like) and the exercise stopping step (FIG. 12, S40A or the like) are repeated alternately. Since the pressuring and exercise step (S30A, S50A, 570A and 590A) and the exercise stopping step (540A, 560A, 580A, S100A) in the present embodiment are substantially the same as the pressuring and exercise step (S30, S50, S70 and S90) and the exercise stopping step (S40, S60, S80, S100) in the first embodiment, their detailed descriptions are omitted. Referring to FIG. 13 and FIGS. 22 to 24, the following describes information displayed on the display 116A of the attachment-type controller 100A when these pressuring and exercise step and exercise stopping step are performed in the present embodiment.

Figure 22:
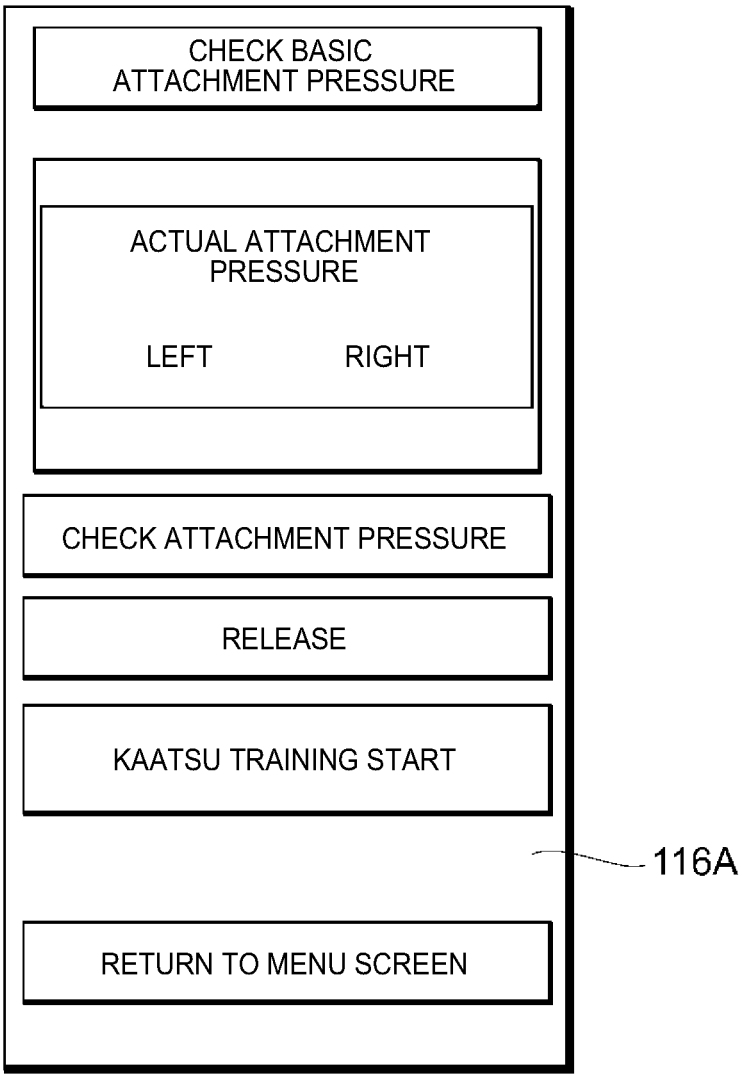
FIG. 22 shows an attachment pressure confirmation screen displayed on a display of the attachment-type controller used in the muscle training method according to the second embodiment of the present invention.
Figure 23:
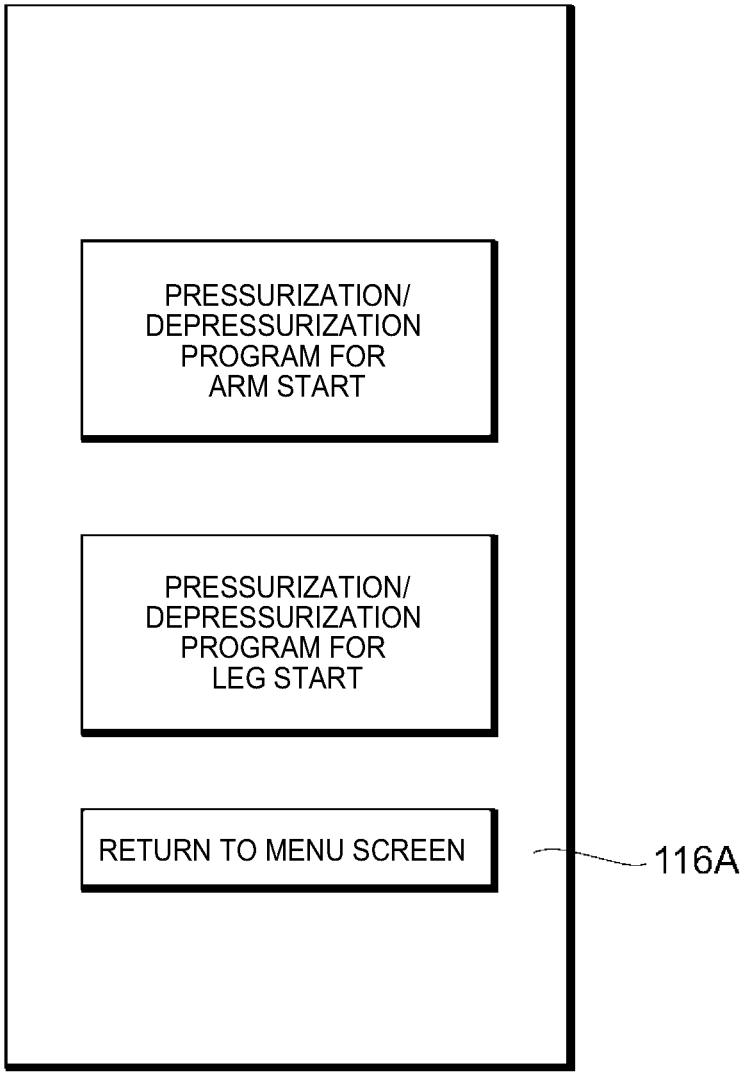
FIG. 23 shows a sub-menu screen displayed on a display of the attachment-type controller used in the muscle training method according to the second embodiment of the present invention.
Figure 24:
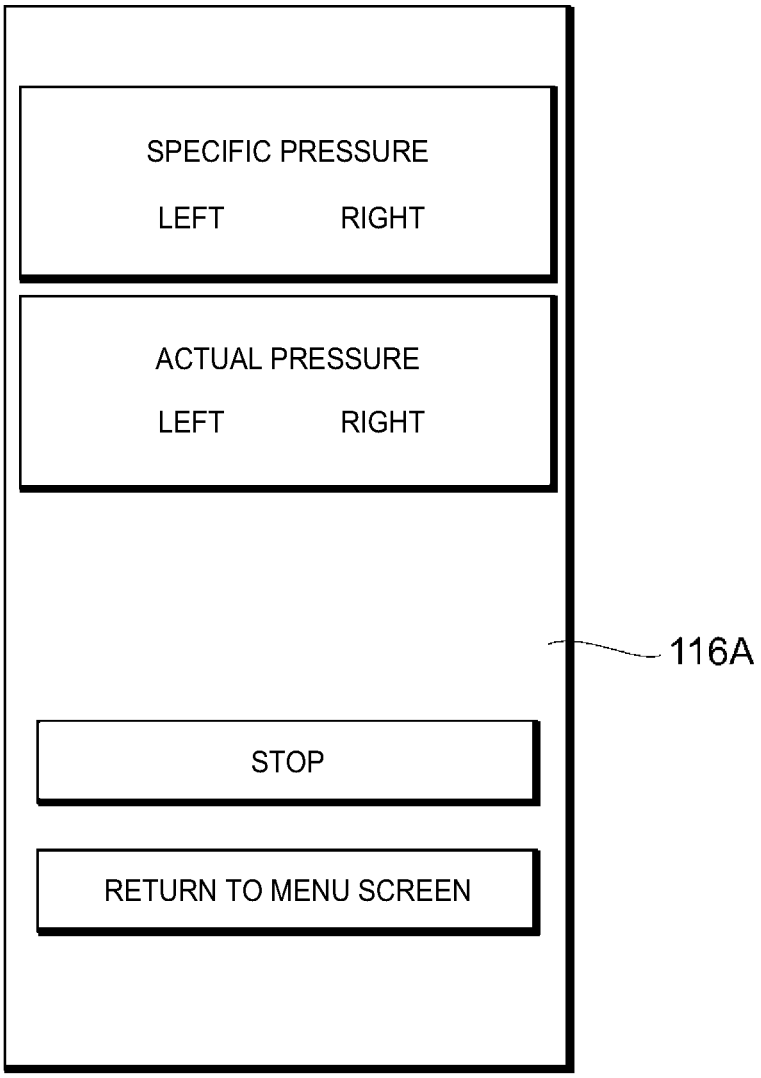
FIG. 24 shows a pressure monitor screen for arms displayed on a display of the attachment-type controller used in the muscle training method according to the second embodiment of the present invention.

Firstly, the button "KAATSU training start" in the menu screen of FIG. 13 is pressed to display the screen for checking attachment pressure shown in FIG. 22. In the screen for checking attachment pressure in FIG. 22, similarly to the screen in FIG. 14, when the button for input operation, named "attachment pressure confirmation" is pressed, then the current attachment pressure of the belt 1A is displayed inside of a monitor frame indicated as "actual attachment pressure". When the button for input operation, named "KAATSU training start" in the screen of FIG. 22 is pressed, a sub-menu screen shown in FIG. 23 is displayed. When the instructor presses the button for input operation, named "KAATSU training start for arms" in the screen of FIG. 23, then a pressure monitor screen for arms shown in FIG. 24 is displayed. In the screen of FIG. 24, the specific pressure input at the system attachment step S20A is displayed inside of the monitor frame displayed as "specific pressure". Meanwhile, pressure actually applied in the pressuring and exercise step and the exercise stopping step is displayed inside of the monitor frame displayed as "actual pressure". The instructor can check whether pressurization can be performed correctly at the pressuring and exercise step and the exercise stopping step based on the information displayed on this pressure monitoring screen. The pressuring and exercise step and the exercise stopping step for legs also can be monitored similarly. Thereafter, the belt 1A and the attachment-type controller 100A are removed from the user (system removal step: S110A), and KAATSU training ends.

According to the muscle training method according to the embodiment described above, the same advantageous effects as those in the first embodiment can be obtained.

In the muscle training system according to the embodiment as described above, the attachment-type controller 100A of a relatively small size is attached to the belt 1A, and the amount of gas supplied to and discharged from the gas bag provided in the belt 1A is controlled by the supplying/discharging control unit (pump 110A and a control unit 120A) of the attachment-type controller 100A, whereby specific pressure can be applied to a specific part of the user from the belt 1A. Then, a plurality of sets of the belt 1A and the attachment-type controller 100A may be used, whereby specific pressure can be applied to a plurality of users at one time, and so muscle training in a group (group lesson) can be implemented.

In the muscle training system according to the embodiment as described above, specific pressure for each user is input at the input operation unit 115A, the thus input specific pressure is recorded at the information recorder 113A, and the specific pressure read from the information recorder 113A can be used to control the amount of gas supplied and discharged. Alternatively, specific pressure is input at the input operation unit 115A, and the thus input specific pressure can be used to control the amount of gas supplied and discharged. Therefore even when specific pressure is recorded at the information recorder 113A beforehand, the specific pressure can be changed flexibly depending on the physical condition or the like of the user. In the muscle training system according to the present embodiment, a pressurization/depressurization program that is warmup exercise of the KAATSU training can be performed automatically using the attachment-type controller 100A, and therefore the workload on the instructor can be reduced greatly.

In the embodiments as stated above, their examples of performing each of the pressuring and exercise step and the exercise stopping step four times are described, and the number of the pressuring and exercise step and the exercise stopping step performed is not limited to four. For instance, the pressuring and exercise step and the exercise stopping step may be performed three times (or five times). In this case as well, the number of load-applied exercise performed in the first pressuring and exercise step may be set more than the number of load-applied exercise performed in a second pressuring and exercise step or later.

EXAMPLES

Referring next to FIG. 25, the following describes examples of the present invention.

In this example, twelve examinees (six males and six females) were asked to perform both of the muscle training method (KAATSU training) according to the present invention and a common muscle training method (hereinafter called "common training"). During these training methods, the perimeter of the triceps and the pectoral muscle of each examinee was measured by electromyogram and their averages were obtained. Then comparison was made between the KAATSU training and the common training about a difference in their muscle strengthening effects.

<KAATSU Training>

Firstly KAATSU training in this example was described. In this example, a belt 1 for arms including the belt 1 made of neoprene rubber (length 70 cm, width 3.0 cm) was used for KAATSU training. As the gas bag (length: 25 cm, width: 3.0 cm), a commercially available rubber bag was used, as the hook-and-loop fastener 10, a commercially available Magic tape (registered trademark) was used, and as the connecting tube 200, a commercially available rubber tube was used. As the pressure applying/removing controller 100 (pumps 110 and control unit 120), a product produced by Takumi denshi cooperation (product name: KAATSU master) was used.

In this example, firstly, specific pressure for each examinee was set (pressure setting step S10). In the pressure setting step S10, the belt 1 was wound around the base of an arm of each examinee for attachment of the belt 1 with the attachment pressure of 60 mmHg (attachment step S11), pressure higher than the attachment pressure by 20 mmHg was applied to each examinee for 30 seconds (pressurization step S12), then the pressure was reduced (depressurization step S14) and the attachment pressure was kept for 10 seconds, followed by increasing of the setting value of the pressure by 20 mmHg (setting-pressure increasing step S15), and the pressurization step S12 was performed again. These steps were repeated until the color of the palm of each examinee turned red or reddish brown.

Subsequently, the belt 1 was wound around the base of an arm of each examinee for attachment (belt attachment step S20), and the specific pressure set at the pressure setting step S10 was applied to each examinee to restrict the blood circulation of the muscles of each examinee without stopping it, and in this state, each examinee was asked to perform load-applied exercise to apply the load of specific weight to the muscles of each examinee (first pressuring and exercise step S30). In this example, bench press exercise to press a barbell upwards by both hands while keeping a supine posture was used as the load-applied exercise. The specific weight (the weight of the barbell) applied to the muscles of each examinee was set at the value of 30% of the maximum weight for each examinee measured beforehand (the weight at which each examinee could press the barbell upward only once). Since the study of the inventor of the present application showed that load-applied exercise performed 25 to 30 times while receiving the specific pressure can increase the level of lactic acid in the blood of each examinee sufficiently, the target number of load-applied exercise performed in the first pressuring and exercise step S30 was set at 30. Note here that the number (30) indicated on the horizontal axis of FIG. 25(A) and FIG. 25(B) was the average of the twelve examinees, and the actual number was different from one person to another (some examinees successfully performed the exercise more than 30 times, and the other examinees performed the exercise less than 30 times only).

Following the first pressuring and exercise step S30, the examinees were asked to stop load-applied exercise while continuously applying the specific pressure (first exercise stopping step S40). In this example, the stopping duration of load-applied exercise in the first exercise stopping step S40 was set at 30 seconds.

Following the first exercise stopping step S40, each examinee was asked to perform load-applied exercise to apply the load of specific weight to the muscles of them while receiving the specific pressure (second pressuring and exercise step S50). The target number of load-applied exercise performed in the second pressuring and exercise step S50 was set at ½ (15 times) of the target number of the load-applied exercise in the first pressuring and exercise step S30. The number (15) indicated on the horizontal axis of FIG. 25(A) and FIG. 25(B) was the average of the twelve examinees, and the actual number was different from one person to another. Thereafter, the load-applied exercise was stopped while continuously applying the specific pressure (second exercise stopping step S60). The stopping duration of load-applied exercise in the second exercise stopping step S60 was set at the same duration (30 seconds) as in that the first exercise stopping step S40.

Following the second exercise stopping step S60, each examinee was asked to perform load-applied exercise to apply the load of specific weight to the muscles of them while receiving the specific pressure (third pressuring and exercise step S70). The target number of load-applied exercise performed in the third pressuring and exercise step S70 was set at ½ or less (7 times) of the target number of the load-applied exercise in the second pressuring and exercise step S50. The number (7) indicated on the horizontal axis of FIG. 25(A) and FIG. 25(B) was the average of the twelve examinees, and the actual number was different from one person to another. Thereafter, the load-applied exercise was stopped while continuously applying the specific pressure (third exercise stopping step S80). The stopping duration of load-applied exercise in the third exercise stopping step S80 was set at the same duration (30 seconds) as in that the first exercise stopping step S40.

Following the third exercise stopping step S80, each examinee was asked to perform load-applied exercise to apply the load of specific weight to the muscles of them while receiving the specific pressure (fourth pressuring and exercise step S90). The target number of load-applied exercise performed in the fourth pressuring and exercise step S90 was set at ½ or less (3 times) of the target number of the load-applied exercise in the third pressuring and exercise step S70. The number (3) indicated on the horizontal axis of FIG. 25(A) and FIG. 25(B) was the average of the twelve examinees, and the actual number was different from one person to another. Thereafter, the load-applied exercise was stopped while continuously applying the specific pressure (fourth exercise stopping step S100). The stopping duration of load-applied exercise in the fourth exercise stopping step S100 was set at the same duration (30 seconds) as in that the first exercise stopping step S40. Thereafter, the belt 1 was removed from each examinee (belt removal step S110), and the KAATSU training ended.

<Common Training>

Next, the common training in this example was described. In this example, a difference between the KAATSU training and the common training resides in that while the specific pressure was applied to each examinee using the belt 1 in the KAATSU training, such specific pressure was not applied to each examine in the common training.

In the common training, firstly, each examinee was asked to perform load-applied exercise to apply the load of specific weight to the muscles of the examinee without applying specific pressure to the examinee (first exercise step). Similarly to the KAATSU training, bench press exercise was used as the load-applied exercise. The specific weight (the weight of the barbell) applied to the muscles of each examinee also was set at the value of 30% of the maximum weight for each examinee similarly to the KAATSU training, and the number of load-applied exercise performed (the number of pressing the barbell upwards) also was set at 30 similarly to the KAATSU training. Next, the load-applied exercise was stopped (first exercise stopping step). The stopping duration in the first exercise stopping step also was set at 30 seconds similarly to the KAATSU training.

Following the first exercise stopping step, each examinee was asked to perform the second load-applied exercise without applying the specific pressure (second exercise step). The number of load-applied exercise performed in the second exercise step was set at 15 similarly to the second pressuring and exercise step S50 in the KAATSU training. Thereafter, each examinee was asked to stop the load-applied exercise (second exercise stopping step). The stopping duration of load-applied exercise in the second exercise stopping step also was set at 30 seconds.

Following the second exercise stopping step, each examinee was asked to perform the third load-applied exercise without applying the specific pressure (third exercise step). The number of load-applied exercise performed in the third exercise step was set at 7 similarly to the third pressuring and exercise step S70 in the KAATSU training. Thereafter, each examinee was asked to stop the load-applied exercise (third exercise stopping step). The stopping duration of load-applied exercise in the third exercise stopping step also was set at 30 seconds.

Following the third exercise stopping step, each examinee was asked to perform the fourth load-applied exercise without applying the specific pressure (fourth exercise step). The number of load-applied exercise performed in the fourth exercise step was set at 3 similarly to the fourth pressuring and exercise step S90 in the KAATSU training. Thereafter, each examinee was asked to stop the load-applied exercise (fourth exercise stopping step). The stopping duration of load-applied exercise in the fourth exercise stopping step also was set at 30 seconds. Thereafter the belt 1 was removed from each examinee (belt removal step), and the common training ended.

Figure 25A:
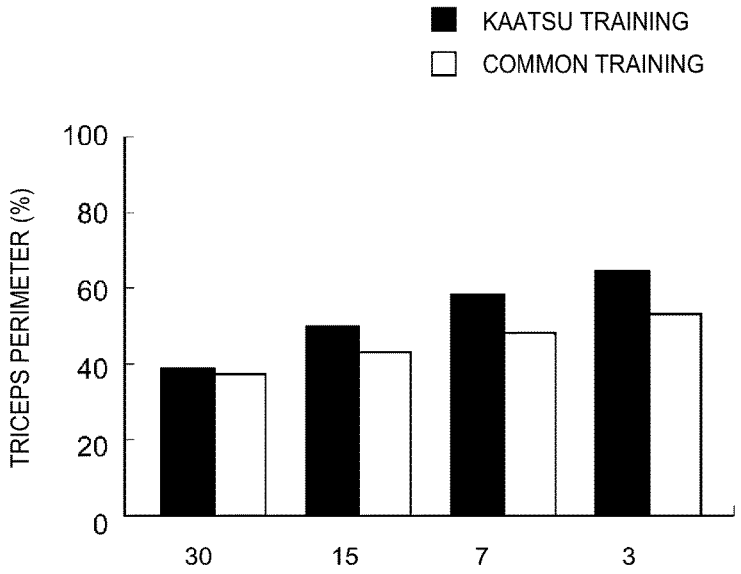
FIG. 25 is a graph for comparison between the effect of strengthening muscles when a muscle training method according examples of the present invention is used and the effect of strengthening muscles when a common muscle training method is used.
Figure 25B:
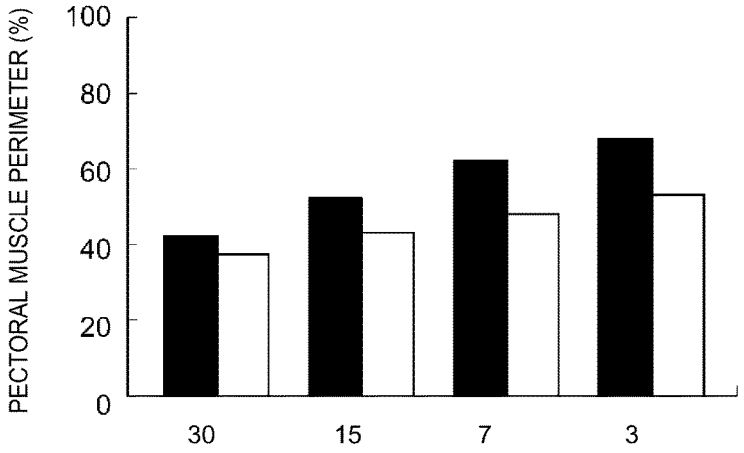

FIG. 25(A) is a graph showing the measurement result of the averages of the perimeter of "the triceps" of each examinee during each exercise step in both of the training methods, and FIG. 25(B) is a graph showing the measurement result of the averages of the perimeter of "the pectoral muscle" of each examinee during each exercise step in both of the training methods. In FIG. 25(A) and FIG. 25(B), the horizontal axis represents time (each exercise step), and the vertical axis represents the measured perimeter (ratio to the maximum perimeter (perimeter when the maximum weight was applied).

FIGS. 25(A) and 25(B) clearly show that the perimeter of the triceps and the pectoral muscle increased significantly when the KAATSU training was performed as compared with the common training. For instance, a comparison between the fourth pressuring and exercise step S90 in the KAATSU training (the step in which load-applied exercise was performed three times while receiving the specific pressure) and the fourth exercise step in the common training (the step in which load-applied exercise was performed three times without receiving the specific pressure) shows that while the perimeter of both of the triceps and the pectoral muscle reached 60 to 70% of the maximum perimeter in the KAATSU training, the perimeter of both of the triceps and the pectoral muscle reached only about 50% of the maximum perimeter in the common training.

The present invention is not limited to the embodiments as stated above, and design modifications to these embodiments, which will be made by a person skilled in the art as appropriate, are also included in the scope of the present invention as long as they have the features of the present invention. That is, each element in the above specific examples and the arrangement, materials, conditions, shapes, dimensions, etc., thereof are not limited to those described above and may be modified as appropriate. Each element in these embodiments can be combined as long as such combination is technically possible, and such a combination also is included in the scope of the present invention as long as they have the features of the present invention.

DESCRIPTION OF REFERENCE NUMERALS

1, 1A belt
100A attachment-type controller
101A case
110A pump (supplying/discharging control unit)
113A information recorder
114A information exchanging unit
115A input operation unit
120A control unit (supplying/discharging control unit)
S10, S10A pressure setting step
S11 attachment step
S12 pressurization step
S14 depressurization step
S30, S30A first pressuring and exercise step
S40, S40A first exercise stopping step
S50, S50A second pressuring and exercise step
S60, S60A second exercise stopping step S70, S70A third pressuring and exercise step
S80, S80A third exercise stopping step
S90, S90A fourth pressuring and exercise step
S100, S100A fourth exercise stopping step
P user

The invention claimed is:

1. A muscle training method, comprising the following steps that are repeated alternately to perform training of a muscle of a user:

a pressuring and exercise step of winding a belt around an arm of the user, the muscle being in the arm of the user, and applying a specific pressure thereto so as to restrict blood circulation to the muscle without stopping the blood circulation, and having the user perform a load-applied exercise to apply a load of specific weight to the muscle of the user; and an exercise stopping step of having the user stop the load-applied exercise while continuously applying the specific pressure to the user, wherein the load-applied exercise is a one-arm curl exercise which is performed by the arm of the user;

wherein the specific weight is set at 20-30% of a maximum weight necessary for the user to exert a maximum muscle force, wherein the pressuring and exercise step is performed three times or more including a first pressuring and exercise step, a second pressuring and exercise step, and a third pressuring and exercise step, wherein a number of the load-applied exercise performed in the second pressuring and exercise step is set at ½ or less of the number of the load-applied exercise performed in the first pressuring and exercise step, and a number of the load-applied exercise performed in the third pressuring and exercise step is set at ½ or less of a number of the load-applied exercise performed in the second pressuring and exercise step, wherein a number of the load-applied exercise performed in the first pressuring and exercise step is set at 25 to 30, wherein, in the exercise stopping step, a stopping duration of the load-applied exercise is set at 10 to 20 seconds, wherein the muscle training method further comprises a pressure setting step to set the specific pressure, wherein the pressure setting step comprises an attachment step, in which the belt is wound around the arm of the user for attachment with a specific attachment pressure, a pressurization step, in which pressure higher than the specific attachment pressure is applied to the user, and a depressurization step, in which the pressure applied in the pressurization step is removed to return to the specific attachment pressure, and wherein the pressurization step and the depressurization step are performed alternately a plurality of times while setting a value of pressure in a given pressurization step larger than a value of pressure in a preceding pressurization step compared to the given pressurization step, and a pressure applied when a color of a palm of the user turns red or reddish brown in the pressurization step is set as the specific pressure.

2. The muscle training method according to claim 1, wherein the number of the load-applied exercise performed in the second pressuring and exercise step is set at 12 to 15.

3. The muscle training method according to claim 2, wherein the number of the load-applied exercise performed in the third pressuring and exercise step is set at 7 to 8.

4. The muscle training method according to claim 3, wherein when the pressuring and exercise step further includes a fourth pressuring and exercise step, wherein, a number of the load-applied exercise performed in the fourth pressuring and exercise step is set at ½ or less of the number of the load-applied exercise performed in the third pressuring and exercise step.

5. The muscle training method according to claim 4, wherein the number of the load-applied exercise performed in the fourth pressuring and exercise step is set at 2 to 3.

6. The muscle training method according to claim 1, wherein in the exercise stopping step, a stopping duration of the load-applied exercise is set at 15 seconds.

* * * * *